US006839057B2

(12) United States Patent
Iguchi

(10) Patent No.: US 6,839,057 B2
(45) Date of Patent: Jan. 4, 2005

(54) CIRCUIT FOR AND METHOD OF DRIVING CURRENT-DRIVEN DEVICE

(75) Inventor: Koichi Iguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 302 days.

(21) Appl. No.: 10/232,659

(22) Filed: Sep. 3, 2002

(65) Prior Publication Data

US 2003/0043131 A1 Mar. 6, 2003

(30) Foreign Application Priority Data

Sep. 5, 2001 (JP) ..... 2001-268915

(51) Int. Cl.[7] ..... G09G 5/00; G09G 3/30
(52) U.S. Cl. ..... 345/204; 345/76
(58) Field of Search ..... 345/44–46, 76, 345/80, 204, 205; 315/169.1, 169.3

(56) References Cited

U.S. PATENT DOCUMENTS 6,091,203 A * 7/2000 Kawashima et al. ..... 345/76

FOREIGN PATENT DOCUMENTS

JP 2000-138572 5/2000
WO WO 99/65011 12/1999

* cited by examiner

*Primary Examiner*—Bipin Shalwala
*Assistant Examiner*—Laurel E. LeFlore
(74) *Attorney, Agent, or Firm*—Young & Thompson

(57) ABSTRACT

Drive circuits are incorporated in an active matrix image display apparatus and drive current-driven devices such as organic EL (electroluminescent) elements. Each of the drive circuits includes a drive transistor for driving the current-driven device and an auxiliary transistor connected parallel to the drive transistor and having a current driving capability which is n times the current driving capability of the drive transistor. In a portion (accelerated period) of a selected period, a drain current flows into the auxiliary transistor and a signal current flowing through a signal line, which represents a current to flow into the current-driven device, is (n+1) times a normal value. As a result, the effect of parasitic capacitors connected to signal lines is reduced, allowing the current-driven devices to be driven with an appropriate drive current even when signal currents are very small.

21 Claims, 23 Drawing Sheets

CIRCUIT FOR AND METHOD OF DRIVING CURRENT-DRIVEN DEVICE

BACKGROUND OF THE INVENTION

1. Field of the Invention

The present invention relates to a circuit for and a method of driving a current-driven device such as an organic EL (electroluminescent) element, and more particularly to an image display apparatus which incorporates such driving circuits and employs current-driven devices as light-emitting elements.

2. Description of the Related Art

In recent years, attention has been attracted to image display apparatus which employ current-driven light-emitting devices such as organic EL elements, for use in computer output devices and cellular phones. The organic EL elements, which are also referred to as organic light-emitting diodes, are advantageous in that they can be driven with a direct current (dc). If organic EL elements are used in an image display apparatus, then they are generally arranged as respective pixels in a matrix on a substrate, providing a display panel. Attempts have been made to construct the image display apparatus in an active matrix configuration in which the organic EL elements of the respective pixels are driven by TFTS (thin-film transistors), which have a MOS (metal oxide semiconductor) transistor structure, formed on the substrate.

Since the organic EL elements are current-driven devices, if they are driven by TFTs in an image display apparatus, then the image display apparatus cannot use the same circuit arrangement as an active matrix liquid crystal image display apparatus which employs liquid crystal cells that are voltage-driven devices. Heretofore, there has been proposed an active matrix drive circuit having organic EL elements and TFTs connected in series with each other and inserted between a power supply line and a ground line, with control voltage being applicable to the gates of the TFTs, holding capacitors connected to the gates of the TFTs for holding the control voltage, and switch elements disposed between a signal line for applying the control voltage to the pixels and the TFTs. In the proposed active matrix drive circuit, the control voltage for the pixels is outputted on the signal line in a time-division multiplexed manner, and the switch elements are controlled so as to be rendered conductive only when the control voltage is outputted to the corresponding pixels. As a result, when a switch element is rendered conductive, the control voltage is applied to the gate of the corresponding TFT, causing a current depending on the control voltage to flow through the organic EL element and charging the holding capacitor with the control voltage. When the switch element is then rendered nonconductive, the holding capacitor keeps on applying the control voltage to the gate of the TFT, continuously causing the current depending on the control voltage to flow through the organic EL element.

Gazette WO 99/65011 discloses a drive circuit having the above circuit arrangement which is suitable for driving current-driven devices such as organic EL elements. FIG. 1 shows the drive circuit disclosed in WO 99/65011. Though n-channel MOS FETs (field effect transistors) are used as drive transistors for driving the current-driven devices (organic EL elements) in a common cathode configuration in WO 99/65011, p-channel MOS FETs are used as drive transistors for driving the current-driven devices in a common anode configuration in FIG. 1.

The drive circuit shown in FIG. 1 has power supply line 1 and ground line 2, and drive transistor 7 as a p-channel MOS FET having a source connected to power supply line 1. Holding capacitor 6 is connected between power supply line 1 and the gate of drive transistor 7, which is connected to one end of a switch element 9. The drain of drive transistor 7 is connected to the other end of the switch element 9 and an end of switch element 10 whose other end is connected to the anode of current-driven device 11. The cathode of current-driven device 11 is connected to ground line 2. A current flowing from drive transistor 7 into current-driven device 11, i.e., a drive current, is represented by $I_{drv}$.

Signal line 3 is provided in order to indicate the drive current $I_{drv}$ to flow into current-driven device 11. Signal line 3 is connected to an end of switch element 8 whose other end is connected to the drain of drive transistor 7. A current flowing through signal line 3 is represented by $I_{in}$.

Switch elements 8 through 10 are turned on and off depending on external control signals, and comprise MOS FETS, for example. Control signals for switch elements 8 through 10 are generated by a control signal generating circuit, not shown, and supplied from output terminals of the control signal generating circuit through control lines, not shown, to switch elements 8 through 10. If switch elements 8 through 10 comprise MOS FETS, then control signals therefor are binary signals electrically representing a ground potential or a power supply potential, and applied to the gates of the MOS FETS.

The drive circuit shown in FIG. 1 is a circuit for driving one pixel, i.e., one current-driven device 11. If an image display apparatus comprises organic EL elements used as current-driven devices 11, then current-driven devices 11 are arranged in a matrix as described above, and the drive circuit shown in FIG. 1, particularly a circuit enclosed by the broken line, is associated with each of current-driven devices 11. Power supply line 1 and ground line 2 are provided commonly for each drive circuit, and signal line 3 is provided commonly for each vertical array of drive circuits, i.e., a column of drive circuits. The control lines are provided commonly for each horizontal array of drive circuits, i.e., a row of drive circuits.

The current-driven devices and the drive circuits thus arranged in a matrix make up an active matrix image display apparatus. Because of structural features of the drive circuits and the image display apparatus, each signal line 3 extends across the control lines for controlling switch elements 8 through 10 and power supply lines 1 and ground lines 2, with an insulating layer interposed therebetween, and parasitic capacitors are produced in regions at the points of intersection where signal line 3 traverses the control lines, power supply lines 1, and ground lines 2. If the current-driven devices 11 comprise organic EL elements, then the regions where the cathodes of current-driven devices 11 connected to ground line 2 cross signal lines 3 have a large area, and parasitic capacitors produced in those regions are not negligible. As a result, as shown in FIG. 1, an equivalent parasitic capacitor is formed between signal line 3 and power supply line 1, and another equivalent parasitic capacitor is formed between signal line 3 and ground line 2. The capacitance of each of these equivalent parasitic capacitors depend on the number of pixels and the structure of the image display apparatus, and may, for example, be at least 10 times the capacitance of holding capacitor 6 at each pixel.

Operation of the conventional drive circuit shown in FIG. 1 will be described below. It is assumed for the description of operation that a number of current-driven devices 11 are arranged in a matrix and combined with respective drive circuits.

The control signal generating circuit generates control signals for successively selecting rows of drive circuits one at a time, and supplies the control signals to switch elements 8 through 10 of the drive circuits through the control lines. In synchronism with the control signals, a signal current $I_{in}$ is supplied to signal lines 3 for the drive circuits belonging to the selected rows. As a result, the signal current $I_{in}$ flows into drive transistors 7 of the drive circuits in the selected rows, and corresponding holding capacitors 6 hold a potential depending on signal current $I_{in}$. When those drive circuits are unselected because the control signals select a next row of drive circuits, the drive circuits keep driving respective current-driven devices 11 with the same drive current $I_{drv}$ as the signal current $I_{in}$.

FIG. 2 shows a timing chart of operation of the drive circuits. First, details of operation of the drive circuits in a selected period will be described below.

When a certain row of drive circuits enters a selected period, switch elements 8, 9 are rendered conductive (i.e., ON state) and switch element 10 is rendered nonconductive (i.e., OFF state). A certain shorter period in the leading end of the selected period serves a reset period, and during the reset period, the potential of signal line 3 is preferably held at the power supply potential, and the potential of signal line 3 and the potential of drive transistor 7 are preferably reset to the power supply potential. After elapse of the reset period, a signal current $I_{in}$ which is equal to a current to flow into current-driven device 11 is supplied to signal line 3. The signal current $I_{in}$ may be supplied to signal line 3 during the reset period.

In the illustrated example, the signal current $I_{in}$ represents the sum of a drain current flowing from the drain of drive transistor 7 toward signal line 3, a current flowing to charge parasitic capacitor 4 and holding capacitor 6, and a current discharged from parasitic capacitor 5. When the reset period is over and the signal current $I_{in}$ starts to flow, the signal current $I_{in}$ charges parasitic capacitor 4 and holding capacitor 6, parasitic capacitor 5 is discharged, and the gate potential of drive transistor 7 is gradually lowered until finally a gate-to-source potential corresponding to a drain current equal to the signal current $I_{in}$ is developed on drive transistor 7.

If the signal current $I_{in}$ is sufficiently large, then since parasitic capacitor 4 and holding capacitor 6 are charged and parasitic capacitor 5 is discharged quickly, the drain current from drive transistor 7 reaches the signal current $I_{in}$ during the selected period, and the voltage across holding capacitor 6 reaches a value to produce a drain current equal to the signal current $I_{in}$. If the signal current $I_{in}$ is small, then the charging of parasitic capacitor 4 and holding capacitor 6 and the discharging of parasitic capacitor 5 are not completed during the selected period. Therefore, the drain current from drive transistor 7 does not reach the signal current $I_{in}$, and the gate-to-source potential of drive transistor 7 does not reach a value corresponding to a drain current equal to the signal current $I_{in}$.

When the selected period is over and an unselected period is reached, switch elements 8, 9 are rendered nonconductive and switch element 10 is rendered conductive at the start of the unselected period. As a result, drive transistor 7 supplies the drive current $I_{drv}$ to current-driven device 11. As the gate of drive transistor 7 is disconnected from signal line 3, the gate potential of drive transistor 7 is held at a value determined immediately before the unselected period is reached, by the action of holding capacitor 6. If the signal current $I_{in}$ in the selected period has been sufficiently large, then since the gate potential of drive transistor 6 has been determined at a value corresponding to a drain current equal to the signal current $I_{in}$, a drive current $I_{drv}$ equal to the signal current $I_{in}$ continuously flows into current-driven device 11. Therefore, the relationship $I_{in}=I_{drv}$ is satisfied. Conversely, if the signal current $I_{in}$ in the selected period has been small, then since the gate potential of drive transistor 6 has not reached a value to supply a drain current equal to the signal current $I_{in}$, a drive current $I_{drv}$ different from the signal current $I_{in}$ continuously flows into current-driven device 11. Therefore, the relationship $I_{in} \approx I_{drv}$ is satisfied.

FIG. 3 shows the relationship between the signal current (input signal) $I_{in}$ and the drive current $I_{drv}$ in the drive circuit shown in FIG. 1. If current-driven devices 11 comprise organic EL elements, then the graph represents the relationship between signal current $I_{in}$ that is input and the luminance. In FIG. 3, an ideal relationship is indicated by the broken-line curve, and an actual relationship between the signal current and the drive current by the solid-line curve. It can be seen from FIG. 3 that the conventional drive circuit is unable to provide a drive current corresponding to signal current $I_{in}$ in a region where signal current $I_{in}$ is small.

As described above, the conventional drive circuit cannot provide a desired drive current when the input signal (signal current) is small because of the times required to charge and discharge the parasitic capacitors and the holding capacitor. If the conventional drive circuit is incorporated in an image display apparatus, then the image display apparatus fails to provide a desired level of luminance. Particularly if the conventional drive circuit is incorporated in an image display apparatus using organic EL elements, then because a current flowing into an organic EL element corresponding to each pixel is very small, images displayed by the image display apparatus are liable to deteriorate, and the luminance controllability thereof is lowered.

SUMMARY OF THE INVENTION

It is therefore an object of the present invention to provide a drive circuit which is suitable for active matrix driving and is able to output an appropriate drive current even when a signal current (input signal) is very small.

Another object of the present invention to provide a driving method which lends itself to an active matrix drive process and is capable of outputting an appropriate drive current even when a signal current (input signal) is very small.

Still another object of the present invention to provide an active matrix image display apparatus for driving current-driven light-emitting devices with an appropriate drive current even when an input signal is very small.

The first object can be achieved by a drive circuit for driving a current-driven device, comprising: a signal line for passing therethrough a signal current corresponding to a drive current of the current-driven device; a drive transistor having a gate, a drain, and a source connected to a power supply line; a holding capacitor connected between the power supply line and the gate of the drive transistor; a first switch element for connecting the signal line and the drain of the drive transistor to each other; a second switch element for connecting the gate and drain of the drive transistor to each other; a third switch element for connecting the drain of the drive transistor and an end of the current-driven device to each other; an auxiliary transistor having a gate connected to the gate of the drive transistor, a source connected to the source of the drive transistor, and a drain connected to the drain of the drive transistor; and a fourth switch element for turning on and off a source-to-drain current of the auxiliary transistor.

The second object can be achieved by a method of driving a current-driven device, comprising the steps of: providing a drive circuit according to the present invention; alternately establishing a selected period in which the current-driven device is selected and a signal current for the current-driven device is passed through the signal line, and an unselected period in which the current-driven device is not selected; keeping the first, second, and fourth switch element nonconductive and keeping the third switch element conductive in the unselected period; rendering the first and second switch elements conductive and rendering the third switch element nonconductive when the unselected period changes to the selected period; establishing an accelerated period in the selected period, and rendering the fourth switch element conductive and making the magnitude of the signal current flowing through the signal line (n+1) times a normal value in the accelerated period where n represents the ratio of a current driving capability of the auxiliary transistor to a current driving capability of the drive transistor; and holding the fourth switch element nonconductive and returning the magnitude of the signal current to the normal value after the accelerated period is finished until the selected period is finished.

The third object can be achieved by an image display apparatus comprising: a matrix of light-emitting devices for emitting light when driven by a current, the light-emitting devices being associated with respective pixels; a plurality of signal lines provided in respective columns of the pixels for supplying signal currents corresponding to drive currents for the light-emitting devices associated with selected ones of the pixels; and a plurality of control lines provided in respective rows of the pixels for transmitting control signals; each of the pixels comprising: a drive transistor having a gate, a drain, and a source connected to a power supply line; a holding capacitor connected between the power supply line and the gate of the drive transistor; a first switch element for connecting the signal line and the drain of the drive transistor to each other depending on the control signal; a second switch element for connecting the gate and drain of the drive transistor to each other depending on the control signal; a third switch element connecting the drain of the drive transistor and an end of the light-emitting device to each other depending on the control signal; an auxiliary transistor having a gate connected to the gate of the drive transistor, a source connected to the source of the drive transistor, and a drain connected to the drain of the drive transistor; and a fourth switch element for turning on and off a source-to-drain current of the auxiliary transistor depending on the control signal.

With the above arrangement, the drive circuit includes a drive transistor for driving the current-driven device, and an auxiliary transistor connected parallel to the drive transistor and having a current driving capability which is n times the current driving capability of the drive transistor. In a portion (accelerated period) of a selected period, a drain current flows into the auxiliary transistor and a signal current flowing through a signal line, which represents a current to flow into the current-driven device, is (n+1) times a normal value. As a consequence, the holding capacitor and parasitic capacitors are quickly charged and discharged, allowing the gate potential of the drive transistor to reach a predetermined potential reliably within the selected period. The current-driven device can thus be driven by an appropriate drive current even when the signal current (input signal) is very small. If the current-driven device comprises an organic EL element, then the quality of a displayed image is prevented from being degraded because the organic EL element can be driven by an intended drive current.

The above and other objects, features, and advantages of the present invention will become apparent from the following description with reference to the accompanying drawings which illustrate examples of the present invention.

DETAILED DESCRIPTION OF THE INVENTION

Figure 1:
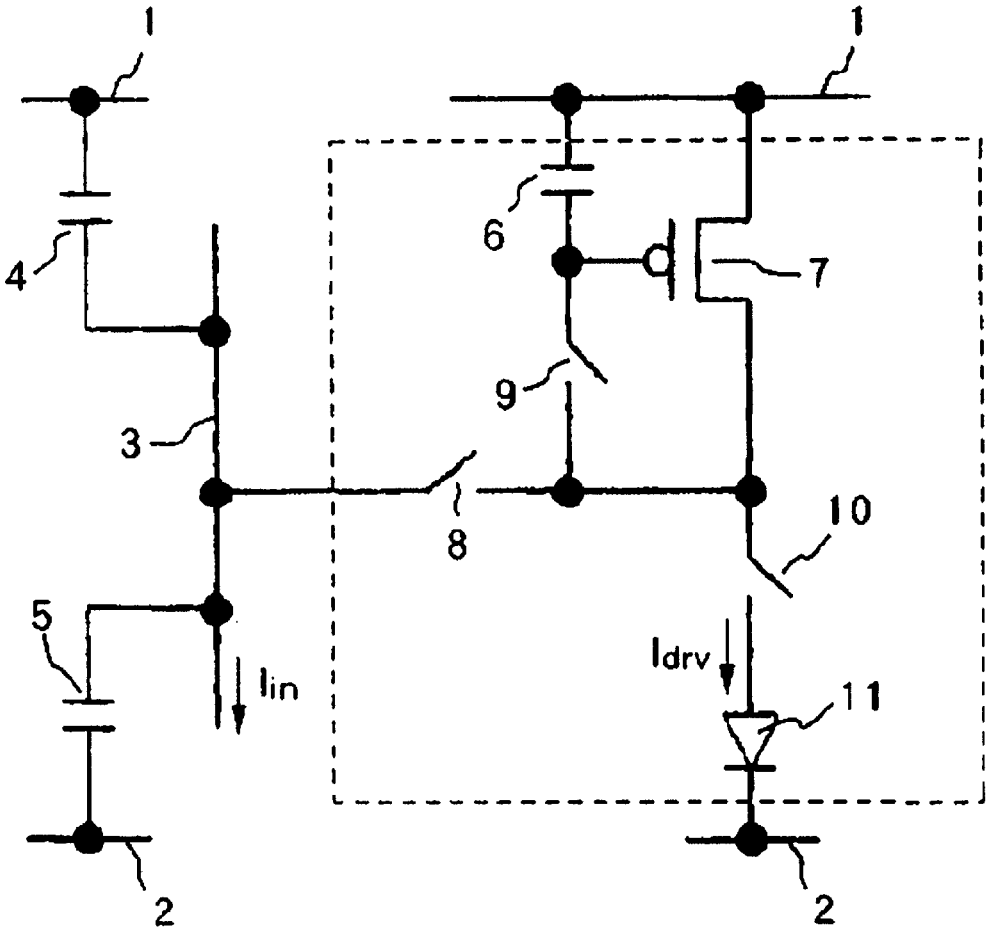
FIG. 1 (BACKGROUND ART)
FIG. 1 is a circuit diagram of an example of a conventional drive circuit.
Figure 2:
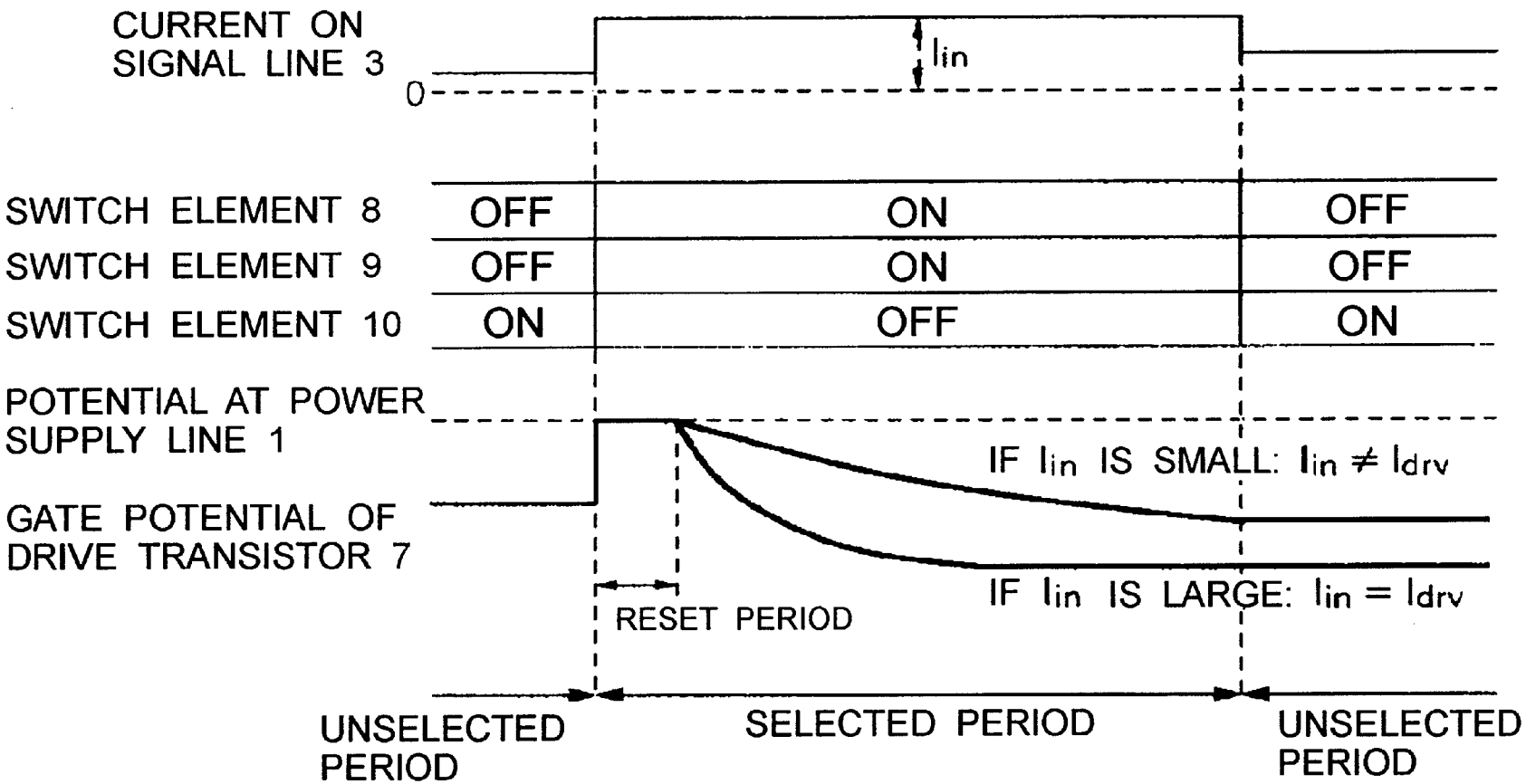
FIG. 2 (BACKGROUND ART)
FIG. 2 is a timing chart showing operation of the drive circuit shown in FIG. 1.
Figure 4:
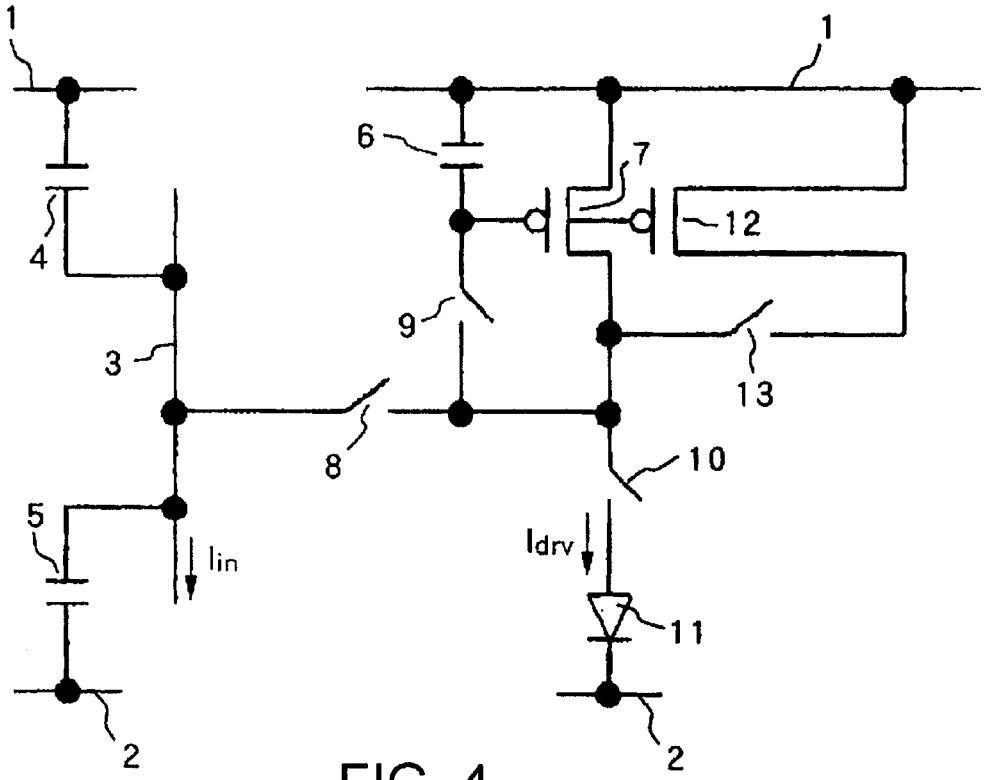
FIG. 4 is a circuit diagram of a drive circuit according to a first embodiment of the present invention.

FIG. 4 shows a drive circuit according to a first embodiment of the present invention, which differs from the conventional drive circuit shown in FIG. 1 in that an auxiliary transistor 12 is connected parallel to a drive transistor 7 and a switch element 13 is connected to the auxiliary transistor 12 for turning on and off a drain current of the auxiliary transistor 12. Those parts shown in FIG. 4 which are identical to those shown in FIG. 1 are denoted by identical reference characters.

In the drive circuit shown in FIG. 4, drive transistor 7 as a p-channel MOS FET has a source connected to power supply line 1. Holding capacitor 6 is connected between power supply line 1 and the gate of drive transistor 7, which is connected to one end of switch element 9. The drain of drive transistor 7 is connected to the other end of the switch element 9 and an end of a switch element 10 whose other end is connected to the anode of current-driven device 11. The cathode of current-driven device 11 is connected to ground line 2. A current flowing from drive transistor 7 into current-driven device 11, i.e., a drive current, is represented by $I_{drv}$.

Auxiliary transistor 12 comprises a p-channel MOS transistor as with drive transistor 7. However, auxiliary transistor 12 has such characteristics that when the same gate-to-source voltage is applied to auxiliary transistor 12, auxiliary transistor 12 produces a drain current which is n times the drain current of drive transistor 7. Thus, auxiliary transistor 12 has a current driving capability which is n times that of drive transistor 7 where n has no upper limit and is determined depending on the minimum value of the signal current $I_{in}$, the capacitance of each of holding capacitor 6 and parasitic capacitors 4, 5, and the duration of the selected period. Typically, n should preferably be 5 or greater. However, an extremely large value of n is not preferable as it would make too large an area taken up by auxiliary transistor 12 and would result in an increase in power consumption thereof.

Drive transistor 7 and auxiliary transistor 12 may be fabricated on the same semiconductor substrate according to the same semiconductor fabrication process such that auxiliary transistor 12 has a channel length which is the same as drive transistor 7 and a channel width which is n times the drive transistor 7. Alternatively, if n is an integer, then n transistors, each having the same dimensions as drive transistor 7, may be fabricated, and the drains, gates, and sources of the n transistors may be connected to each other, virtually providing single auxiliary transistor 12. Auxiliary transistor 12 has a source connected to power supply line 1, a gate connected to the gate of drive transistor 7, and a drain connected to one end of switch element 13 whose other end is connected to the drain of drive transistor 7.

Since switch element 13 serves to turn on and off the drain current of the auxiliary transistor 12, it may be connected between power supply line 1 and the source of auxiliary transistor 12. However, if switch element 13 comprises a MOS FET, then since a voltage drop due to the on-resistance of switch element 13 affects operation of the drive circuit, it is preferable to position switch element 13 remotely from the drain of auxiliary transistor 12, i.e., power supply line 1.

Signal line 3 is provided in order to indicate the drive current $I_{drv}$ to flow into current-driven device 11. Signal line 3 is connected to an end of switch element 8 whose other end is connected to the drain of drive transistor 7. A current flowing through signal line 3 is represented by $I_{in}$.

Switch elements 8 through 10, 13 are turned on and off depending on external control signals, and comprise MOS FETS, for example. Control signals for switch elements 8 through 10, 13 are generated by a control signal generating circuit, not shown in FIG. 4, and supplied from output terminals of the control signal generating circuit through control lines, not shown, to switch elements 8 through 10, 13. If switch elements 8 through 10, 13 comprise MOS FETS, then control signals therefor are binary signals electrically representing a ground potential or a power supply potential, and applied to the gates of the MOS FETS. If switch elements 8 through 10, 13 comprise MOS FETS, then it is determined whether they are to be of the p-channel type or the n-channel type individually for each of switch elements 8 through 10, 13.

Figure 5:
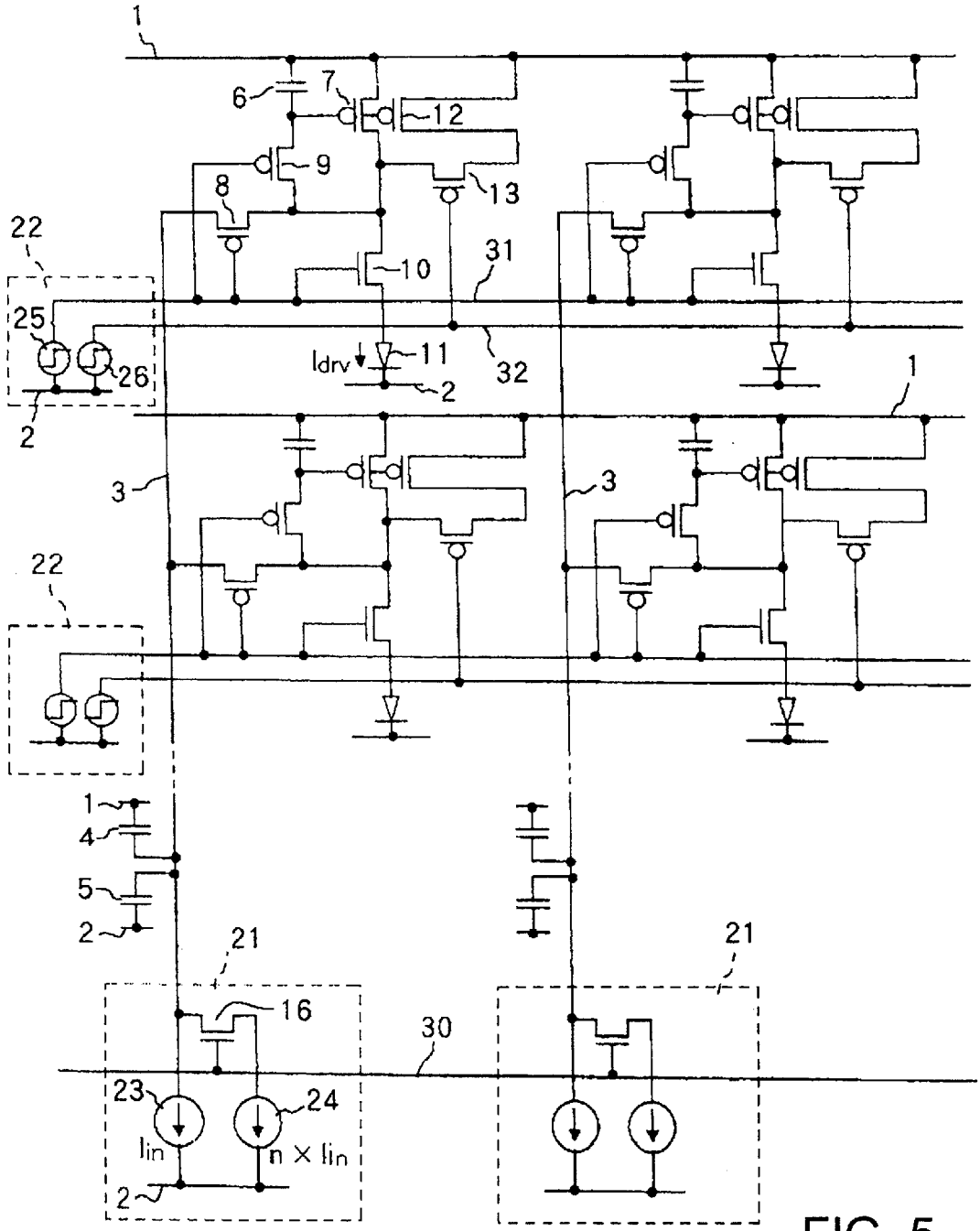
FIG. 5 is a circuit diagram of an image display apparatus which incorporates drive circuits shown in FIG. 4.

The drive circuit shown in FIG. 4 is a circuit for driving one pixel, i.e., one current-driven device 11. If an image display apparatus comprises organic EL elements used as current-driven devices 11, then current-driven devices 11 are arranged in a matrix as described above, and the drive circuit shown in FIG. 1, particularly a circuit enclosed by the broken line, is associated with each of current-driven devices 11. FIG. 5 shows an image display apparatus comprising a matrix of current-driven devices 11 each combined with a drive circuit. Usually, an image display apparatus has several hundred to several thousand pixels contained in each of vertical and horizontal arrays, the illustrated image display apparatus has two pixels in a vertical array×two pixels in a horizontal array.

In the circuit arrangement shown in FIG. 5, drive transistors 7 and auxiliary transistors 12 are fabricated as thin-film transistors of the same conductivity type on the same semiconductor substrate. Switch elements 8, 9 comprise p-channel MOS FETS, and switch elements 10, 13 comprise n-channel MOS FETS. Switch elements 8, 9 should preferably fabricated as thin-film transistors on the substrate.

In this image display apparatus, power supply line 1 and ground line 2 are provided commonly for each row of drive circuits, and signal line 3 is provided commonly for each vertical array of drive circuits, i.e., a column of drive circuits. Signal current generating circuits 21 are connected to respective ends of signal lines 3. In FIG. 5, signal current generating circuits 21 are connected to respective lower ends of signal lines 3. Control signal generating circuits 22 are connected to respective rows of drive circuits for generating control signals to be supplied to the drive circuits in the respective rows.

Each of signal current generating circuits 21 comprises signal source 23 connected to ground line 2 for generating signal current $I_{in}$, signal source 24 connected to ground line 2 for generating a current $n \times I_{in}$ which is n times the signal current $I_{in}$ generated by signal source 23, and switch element 16 comprising an n-channel MOS FET or the like. Signal source 23 is connected directly to signal line 3, and signal source 24 is connected to signal line 3 through switch element 16. Control line 30 is provided for controlling switch element 16. The gates of switch elements 16 of respective signal current generating circuits 21 are connected commonly to control line 30. If switch element 16 is turned on, then a signal current $(n+1) \times I_{in}$ flows through signal line 3, and if switch element 16 is turned off, then the signal current $I_{in}$ flows through signal line 3. A control circuit, not shown, outputs a control signal for making switch elements 16 conductive in an accelerated period (described later on) to control line 30.

Each of control signal generating circuits 22 comprises signal driver 25 for outputting a control signal to be supplied to switch elements 8 through 10 of the drive circuit in the corresponding row, and signal driver 26 for outputting a control signal to be supplied to switch element 13 of the drive circuit in the corresponding row. Control lines 31, 32 are provided in the rows of the image display apparatus. Control line 31 is connected to an end of signal driver 25 for supplying a control signal from signal driver 25 to the gates of switch elements 8 through 10 in the form of MOS FETs in the corresponding row. Similarly, control line 32 is connected to an end of signal driver 26 for supplying a control signal from signal driver 26 to the gates of switch element 13 in the corresponding row. Therefore, control lines 31, 32 extend in the direction (horizontal direction in FIG. 5) of the rows. The other ends of signal drivers 25, 26 are connected to ground line 2. Signal driver 25 generates a control signal for rendering switch elements 8, 9 conductive and switch element 10 nonconductive in the corresponding row in a selected period for the row. Signal driver 26 generates a control signal for rendering switch element 13 conductive in the corresponding row in an accelerated period for the row.

In the active matrix image display apparatus comprising a matrix of current-driven devices and drive circuits, equivalent parasitic capacitor 4 is formed between signal line 3 and power supply line 1, and equivalent parasitic capacitor 5 is formed between signal line 3 and ground line 2 because of structural features of the drive circuits and the image display apparatus, as with the circuit arrangement shown in FIG. 1.

Operation of the drive circuit shown in FIG. 4 will be described below. The drive circuit shown in FIG. 4 is usually incorporated in the image display apparatus shown in FIG. 5. Consequently, operation of the drive circuit as incorporated in the image display apparatus shown in FIG. 5 will be described below.

Each of control signal generating circuits 22 is controlled by a non-illustrated control circuit, and outputs control signals to control lines 31, 32 to sequentially select the rows in the image display apparatus. A period in which a row is selected by control signals in the image display apparatus is referred to as a selected period, and a period in which a row is not selected by control signals in the image display apparatus is referred to as an unselected period.

Since the rows in the image display apparatus are sequentially selected, a selected period for a certain row periodically occurs, and if the number of the rows in the image display apparatus is indicated by N, then the proportion of the selected period in one cycle is about 1/N. During the selected period of a certain row, signal current generating circuit 21 connected to one end of signal line 3 in each column generates a signal current $I_{in}$ corresponding to a drive current $I_{drv}$ to flow into current-driven device 11 in the row at the column, and the generated current $I_{in}$ flows through signal line 3. As a result, corresponding signal currents $I_{in}$ flow into drive transistors 7 of the respective drive circuits in the selected row and voltages corresponding to the-signal currents are held in holding capacitors 6. When these drive circuits are unselected because the control signals select a next row of drive circuits, the drive circuits keep driving respective current-driven devices 11 with the same drive currents $I_{drv}$ as the signal currents $I_{in}$ based on the voltage held by holding capacitors 6 until the drive circuits selected again.

With the circuit according to the present embodiment, in a certain time zone in the leading end of the selected period, a current flows also into auxiliary transistors 12, and a current $(1+n)\times I_{in}$ is supplied to signal lines 3 to charge and discharge quickly parasitic capacitors 4, 5 associated with signal lines 3. Therefore, until the end of the selected period, the drain current from drive transistors 7 reaches the signal current $I_{in}$, and the gate-to-drain potential of drive transistors 7 also reaches a value corresponding to a drain current equal to the signal current $I_{in}$.

Details of the above operation of the drive circuits will be described below with reference to FIG. 6 which is a timing chart of operation of the drive circuits.

When a certain row of drive circuits enters a selected period, switch elements 8, 9 which are p-channel MOS FETs are rendered conductive (i.e., ON state) and switch element 10 which is an n-channel MOS FET is rendered nonconductive (i.e., OFF state) in the drive circuits in the selected row in the selected period by a control signal supplied from control signal generating circuit 22 through control line 31. Switch elements 13, 16 remain nonconductive. Since only current sources 23 in signal current generating circuits 21 are connected to signal lines 3, signal currents $I_{in}$ for the selected row flow through signal lines 3.

Figure 6:
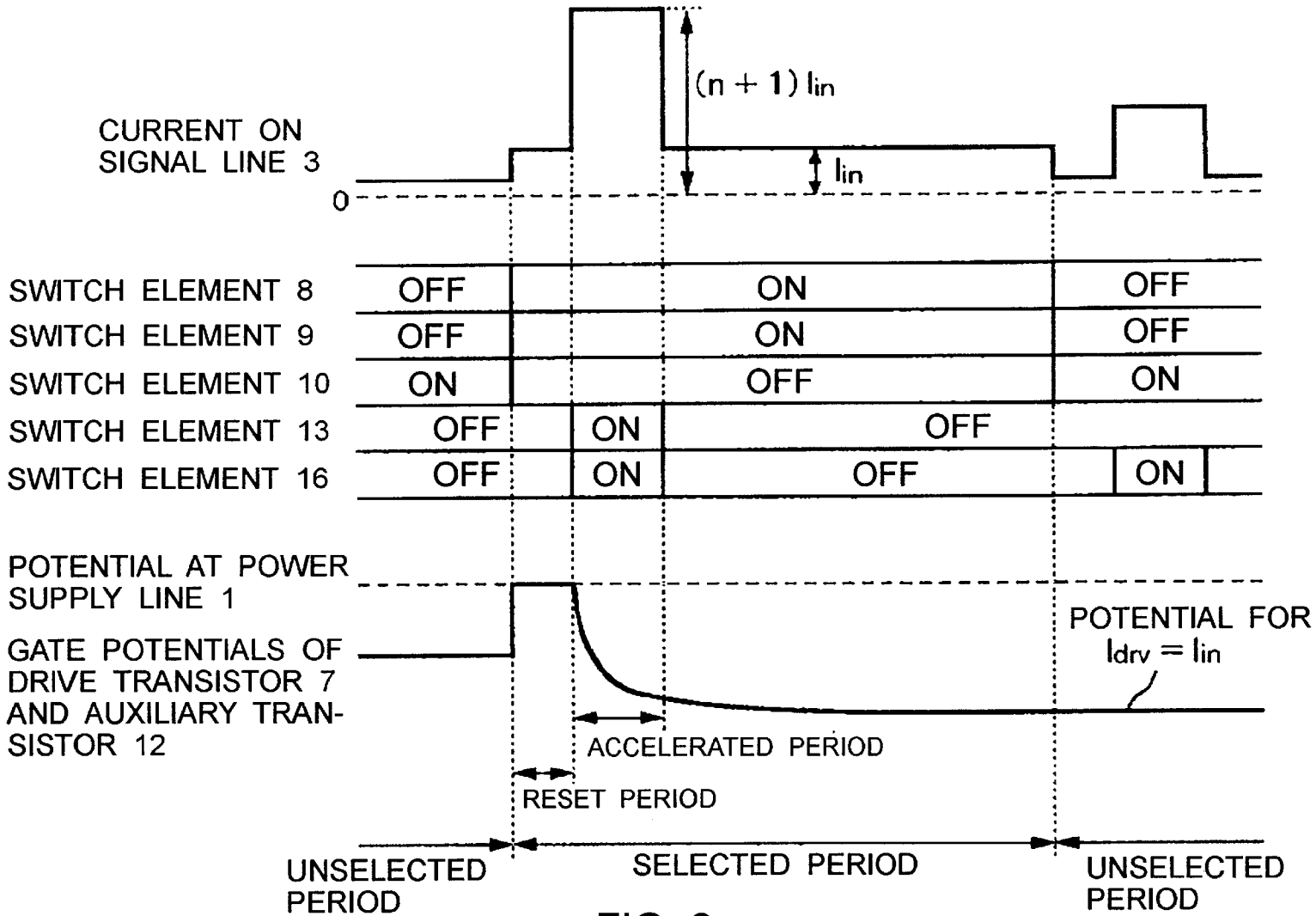
FIG. 6 is a timing chart showing operation of the circuit shown in FIGS. 4 and 5.

In the example shown in FIG. 6, a certain shorter period in the leading end of the selected period serves a reset period, and during the reset period, the potential of signal line 3 is held at the power supply potential, for example, causing parasitic capacitor 4 and holding capacitor 6 to be charged and parasitic capacitor 5 to be discharged smoothly after elapse of the reset period. The reset period may be dispensed with if the gate-to-source voltage of drive transistor 7 may be set to a value depending on the signal current $I_{in}$ quickly by passing the signal current $I_{in}$ through signal line 3 in view of the charging of parasitic capacitor 4 and holding capacitor 6 and the discharging of parasitic capacitor 5. No signal current may flow through signal line 3 during the reset period.

Following the elapse of the reset period, switch elements 13, 16 are rendered conductive for a given period which is referred to as an accelerated period. As a result of switch element 16 being rendered conductive, a current also flows through current source 14 in signal current generating circuit 21, and a current $(n+1)\times I_{in}$, i.e., a current which is (n+1) times a current to flow into current-driven element 11, flows through signal line 3. Since switch element 13 is also rendered conductive, the current $(n+1)\times I_{in}$ is divided to flow through drive transistor 7 and auxiliary transistor 12. Because of the above-described different characteristics of drive transistor 7 and auxiliary transistor 12, a drain current which is n times the drain current flowing through drive transistor 7 flows through drive transistor 12.

A comparison between the drive circuit according to the present embodiment and the conventional drive circuit shown in FIG. 1 will be described below. During the accelerated period, the current flowing through signal line 3 is (n+1) times the current flowing through signal line 3 in the conventional drive circuit, and parasitic capacitor 4 and holding capacitor 6 are charged and parasitic capacitor 5 is discharged quickly due to the signal current which is (n+1) times the signal current in the conventional drive circuit. Consequently, the drain current of drive transistor 7 rapidly approaches signal current $I_{in}$, and the drain current of auxiliary transistor 12 approaches $n\times I_{in}$. The gate potentials of drive transistor 7 and auxiliary transistor 12 are sufficiently close to a potential which is generated when the signal current $I_{in}$ flows between the source and drain of drive transistor 7. The differential potential between this potential and a potential generated when the signal current $I_{in}$ flows through drive transistor 7 is caused by a potential generated because the charging and discharging of the above capacitors is not fully finished and an error of the ratio n between the current flowing through drive transistor 7 and the current flowing through drive transistor 12.

The accelerated period is finished earlier than the selected period. If the value of n is sufficiently large, then the charging of parasitic capacitor 4 and holding capacitor 6 and the discharging of parasitic capacitor 5 are completed at the end of the accelerated period even if the value of the signal current $I_{in}$ is small, and the above differential potential is primarily caused by the error of the ratio n between the current flowing through drive transistor 7 and the current flowing through drive transistor 12. At this time, the differential potential is of at most a small value ranging from several tens millivolts to several hundreds millivolts.

At the same time that the accelerated period is finished, both switch elements 13, 16 are turned off. As a consequence, the current flowing through signal line 3 becomes $I_{in}$, and no current flows through auxiliary transistor 12. Inasmuch as the differential potential is of a small value ranging from several tens milivolts to several hundreds millivolts at the end of the accelerated period, as described above, it is possible to cancel out the differential potential simply by passing the signal current $I_{in}$ through signal line 3 during the remainder of the selected period after the accelerated period. The gate potential of drive transistor 7 has a value corresponding to the signal current $I_{in}$ until the end of the selected period.

The length of the accelerated period may be set to an appropriate value, and may, for example, be set to a length which is about 10 to 50% of the length of the selected period.

Operation of the drive circuits in the unselected period will be described below.

At the time when the selected period changes to the unselected period, switch elements 8, 9 are rendered nonconductive and switch element 10 is rendered conductive. Since switch elements 8, 9 are rendered nonconductive, the gate potential of drive transistor 7 which has previously been determined in the selected period is held by holding capacitor 6. Therefore, in the unselected period in which switch elements 8, 9, 13 are held nonconductive and switch element 10 is held conductive, drive transistor 7 continuously supplies a current corresponding to the gate potential held by holding capacitor 6, i.e., a current equal to the signal current $I_{in}$, as the drive current $I_{drv}$ to current-driven device 11.

Figure 7:
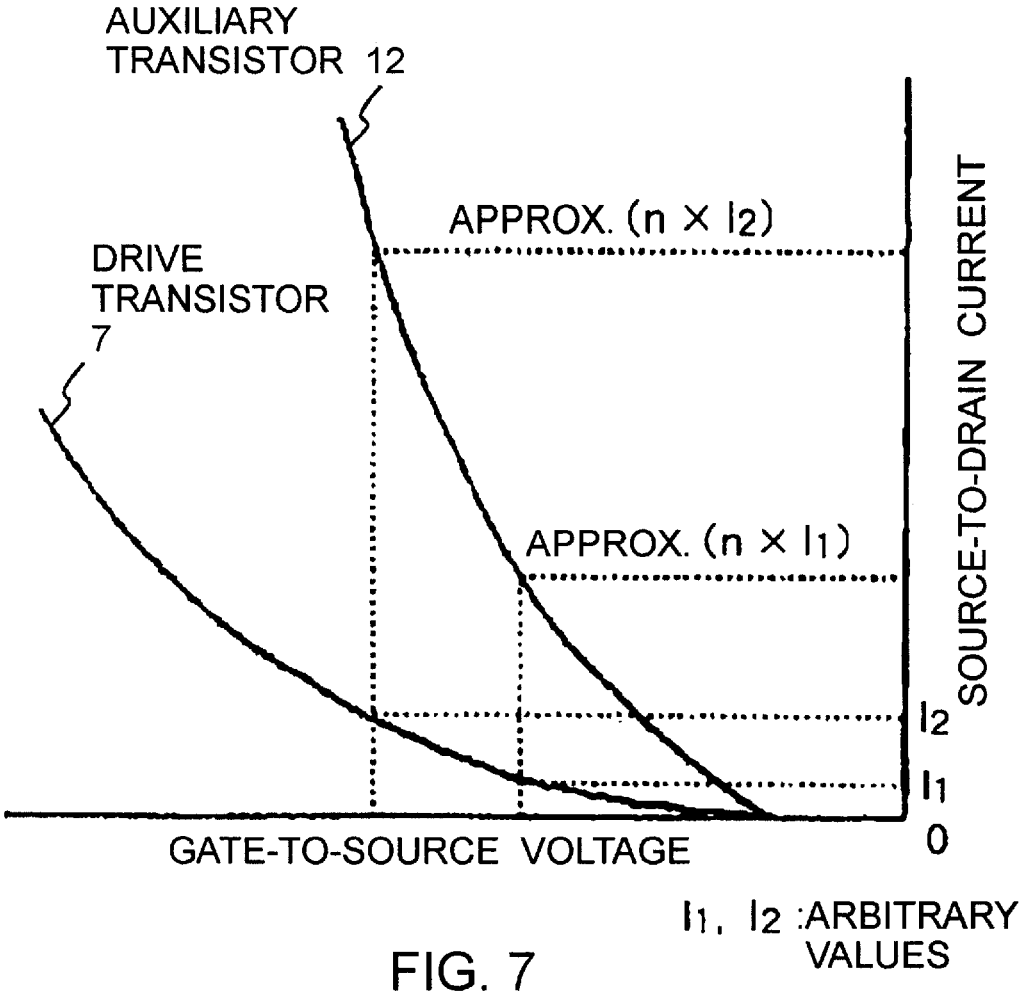
FIG. 7 is a graph showing operation characteristics of a drive transistor and an auxiliary transistor connected parallel to the drive transistor.

FIG. 7 is a characteristic diagram showing the relationship between the gate-to-source potential and the drain current (i.e., source-to-drain current) of drive transistor 7 and auxiliary transistor 12 in the present embodiment. It can be seen from FIG. 7 that when a gate-to-source voltage such that the drain current of drive transistor 7 is $I_1$ is applied to auxiliary transistor 12, the drain current of auxiliary transistor 12 is $n \times I_1$, and similarly when a gate-to-source voltage such that the drain current of drive transistor 7 is $I_2$ ($I_1 > I_2$) is applied to auxiliary transistor 12, the drain current of auxiliary transistor 12 is $n \times I_2$.

The leading portion of the selected period (except for the reset period), typically a front half of the selected period, is used as an accelerated period. During the accelerated period, the current flowing through signal line 3 is made (n+1) times original signal current $I_{in}$, and the auxiliary transistor which has a driving capability n times that of drive transistor 7 is rendered conductive during the accelerated period. Thus, the charging of parasitic capacitor 4 and holding capacitor 6 and the discharging of parasitic capacitor 5 progress rapidly, and the gate potential of drive transistor 7 reaches the original value earlier than with the conventional circuit even if the signal current $I_{in}$ is small. Therefore, current-driven device 11 is energized with an intended drive current. The original value of the gate potential is a value corresponding to the gate-to-source potential corresponding to the signal current $I_{in}$. Therefore, the display image is prevented from being deteriorated and the luminance controllability is prevented from being lowered due to the inconsistency between the drive current $I_{drv}$ and the signal current $I_{in}$.

Figure 3:
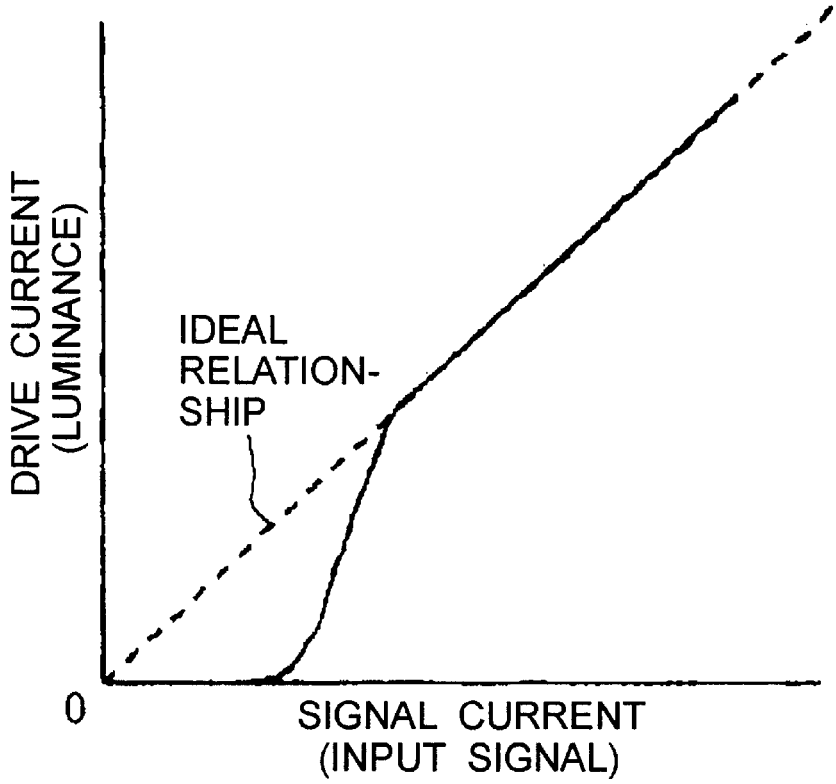
FIG. 3 (BACKGROUND ART)
FIG. 3 is a graph showing the relationship between a signal current $I_{in}$ and a drive current $I_{drv}$ in the drive circuit shown in FIG. 1.
Figure 8:
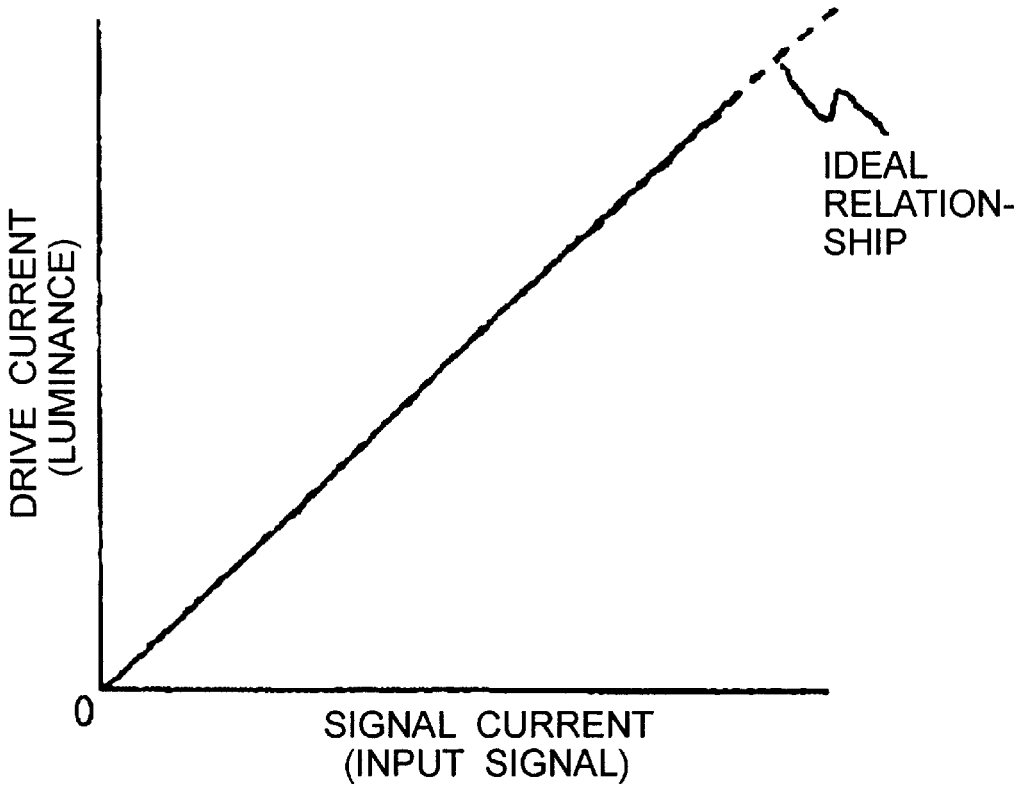
FIG. 8 is a graph showing the relationship between a signal current $I_{in}$ and a drive current $I_{drv}$ in the drive circuit shown in FIG. 4.

FIG. 8 is a graph showing the relationship between the signal current (input signal) $I_{in}$ and the drive current $I_{drv}$ in the present drive circuit. If current-driven device 11 comprises an organic EL element, then the drive current $I_{drv}$ in the graph shown in FIG. 8 may directly be replaced with a luminance. A comparison between the graph shown in FIG. 8 and the graph (see FIG. 3) which shows the relationship between the signal current $I_{in}$ and the drive current $I_{drv}$ in the conventional circuit indicates that the drive circuit according to the present embodiment keeps the signal current $I_{in}$ and the drive current $I_{drv}$ linearly related to each other even in a region where the signal current $I_{in}$ is small.

Modifications of the circuit according to the present embodiment will be described below.

Figure 9:
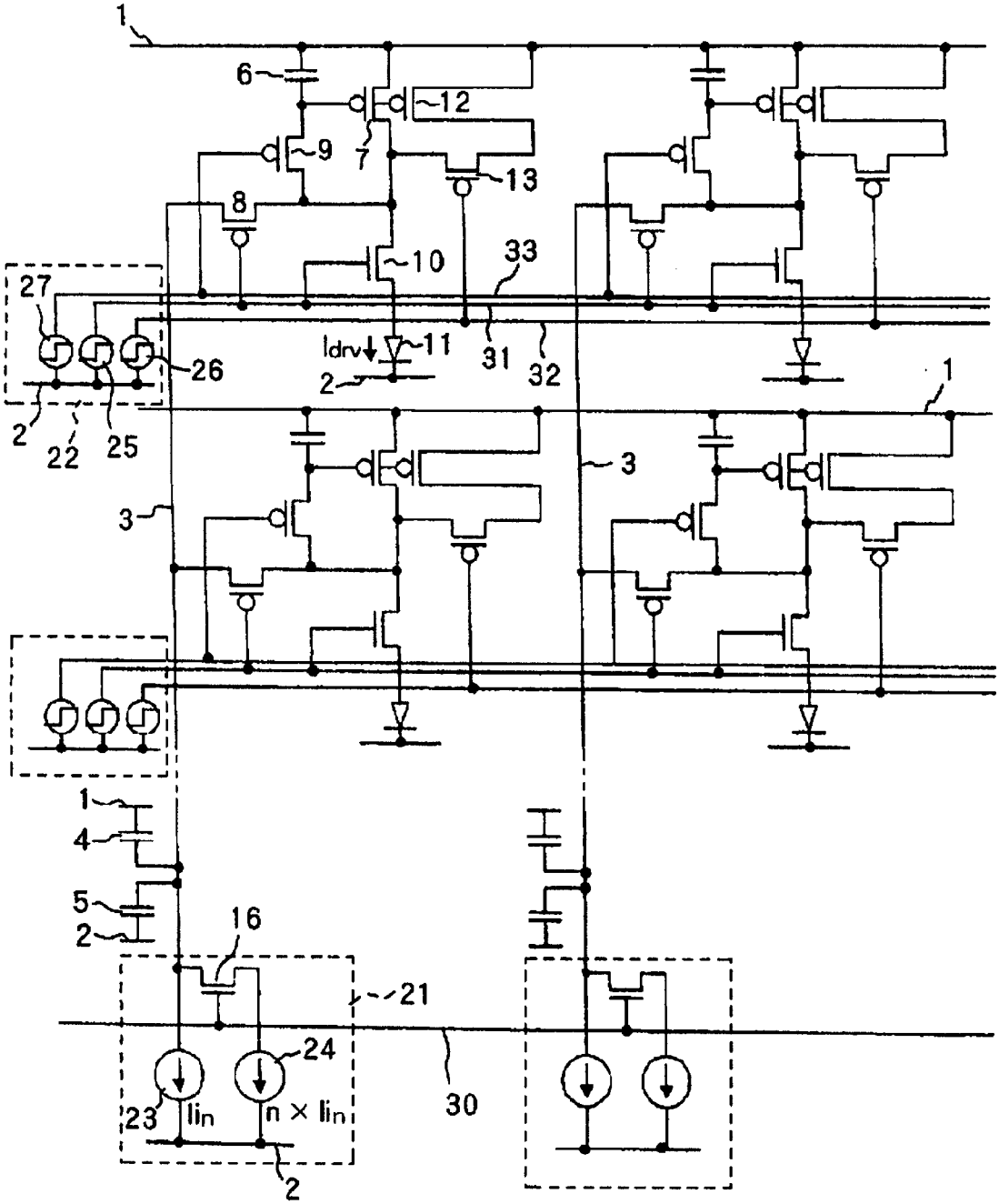
FIG. 9 is a circuit diagram of a modification of the circuit shown in FIGS. 4 and 5.
Figure 10:
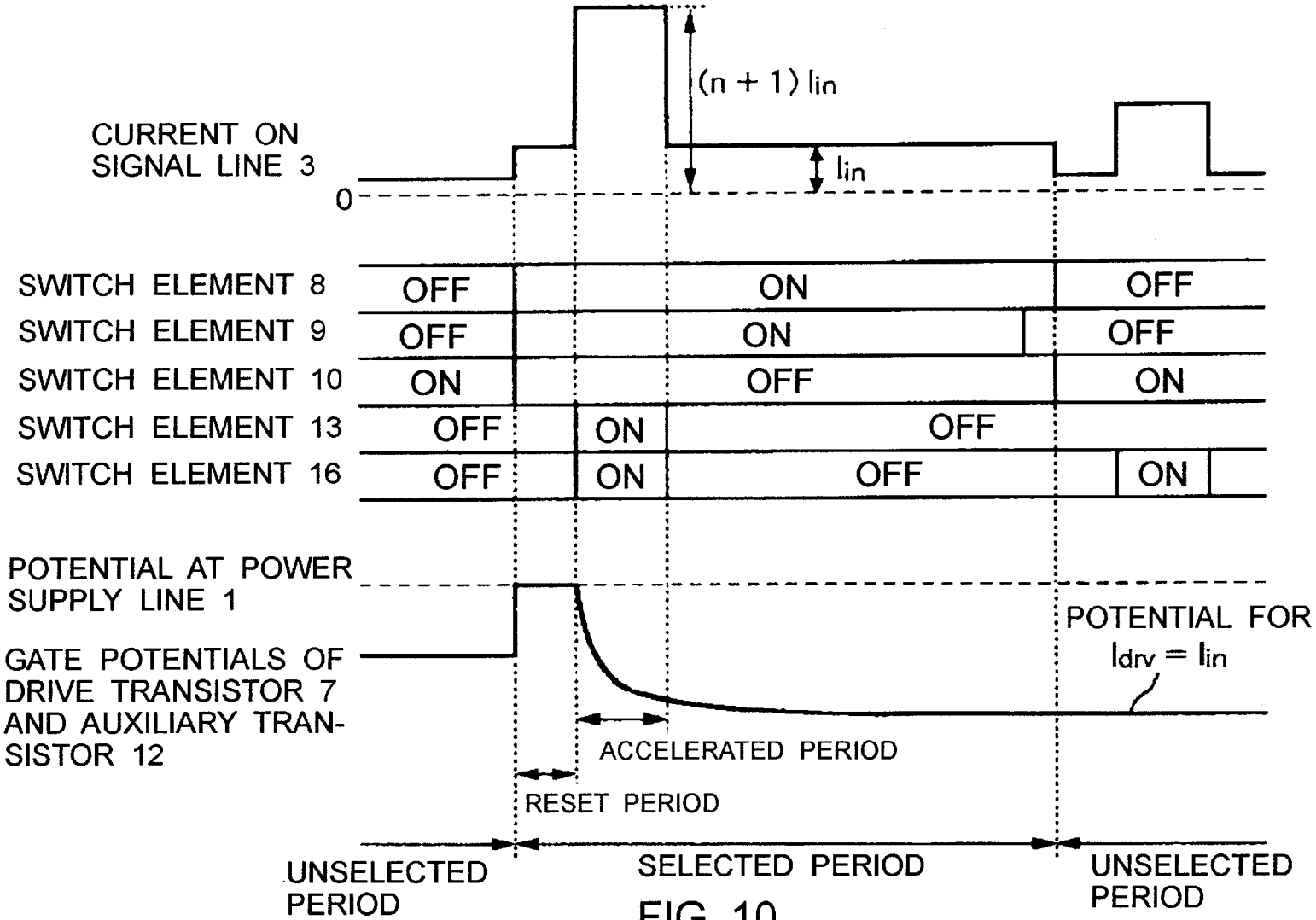
FIG. 10 is a timing chart showing operation of the circuit shown in FIG. 9.

In the above drive circuit, when the selected period changes to the unselected period, switch element 8 and switch element 9 are simultaneously rendered nonconductive. However, in order to hold the gate potential more reliably with holding capacitor 6, switch element 9 may be rendered nonconductive before the selected period changes to the unselected period. FIG. 9 is a circuit diagram of an image display apparatus which includes such drive circuits, and FIG. 10 is a timing chart of operation of the circuit shown in FIG. 9.

The circuit shown in FIG. 9 is a modification of the circuit shown in FIGS. 4 and 5 in that signal driver 27 is added to each control signal generating circuit 21 and supplies a control signal to the gates of switch elements 9 in the drive circuits in the corresponding row through control line 33. Only the gates of signal lines 8, 9 are connected to control line 32. Signal driver 27 generates such a control signal that switch element 9 is changed from the nonconductive state to the conductive state at the same time that the unselected period changes to the selected period, and after the accelerated period is finished, as shown in FIG. 10, switch element 9 is changed from the conductive state to the nonconductive state slightly before the selected period changes to the unselected period. With this arrangement, holding capacitor 6 can reliably be disconnected from signal line 3 before the unselected period is reached, making it possible to hold the gate potential with holding capacitor 6 reliably until the unselected period is finished. Switch element 9 may be rendered nonconductive anytime after the gate potential of drive transistor 7 drops to the gate-to-source voltage at which a drain current in conformity with the signal current $I_{in}$ is generated.

Figure 11:
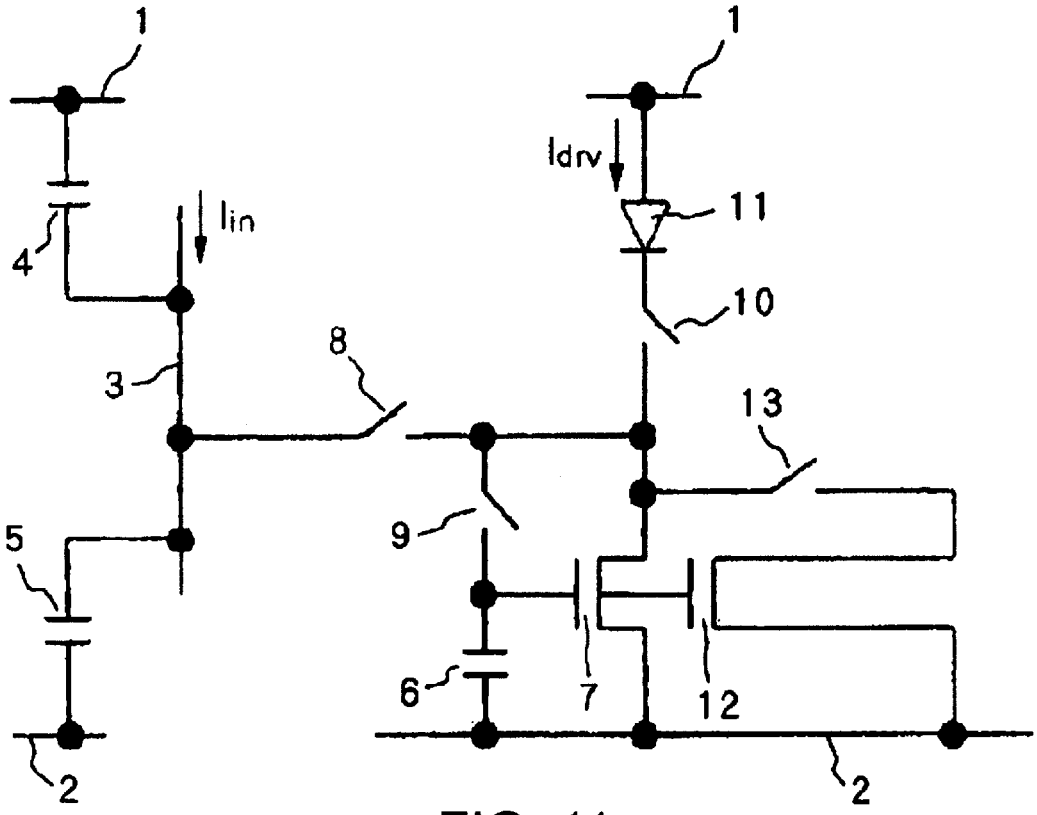
FIG. 11 is a circuit diagram of another modification of the circuit shown in FIG. 4.

FIG. 11 shows another modification of the drive circuit according to the first embodiment. In the above circuit, if current-driven device 11 comprises an organic EL element, then the organic EL element is used in a common cathode configuration, and p-channel MOS FETS are used as drive transistor 7 and auxiliary transistor 12. In the circuit shown in FIG. 11, an organic EL element is used in a common anode configuration, i.e., the anode of an organic EL element used as current-driven device 11 is connected directly to power supply line 1, and drive transistor 7 and auxiliary transistor 12, each comprising an n-channel MOS FET, are associated with the cathode of the organic EL element. Specifically, the layout of the components is reversed between power supply line 1 and ground line 2, and the conductivity type of drive transistor 7 and auxiliary transistor 12 is also reversed. With this arrangement, the signal current $I_{in}$ flows from signal line 3 through switch element 8 and drive transistor 7 into ground line 2. If switch elements 8 through 10, 13 comprise MOS FETS, then their conductivity type should preferably be a reversal of the conductivity type in the circuit shown in FIGS. 4 and 5.

Operation of the circuit shown in FIG. 11 is similar to operation of the circuit shown in FIG. 4 except that the polarity is reversed.

Figure 12:
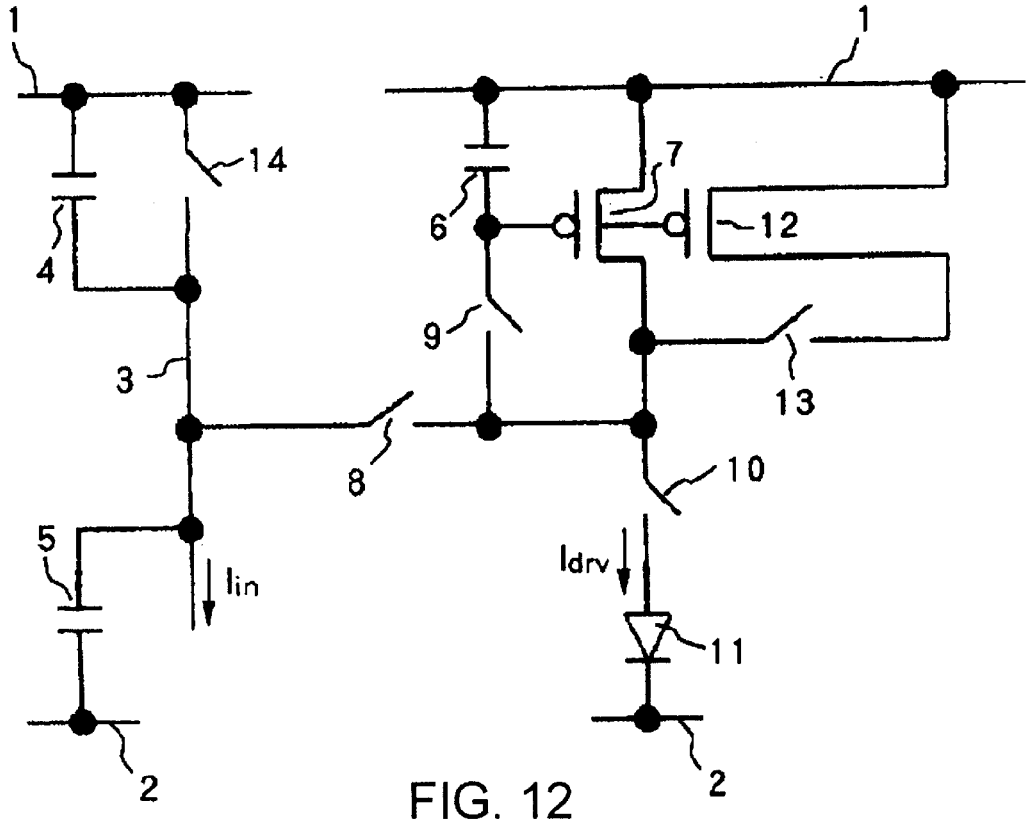
FIG. 12 is a circuit diagram of a drive circuit according to a second embodiment of the present invention.
Figure 13:
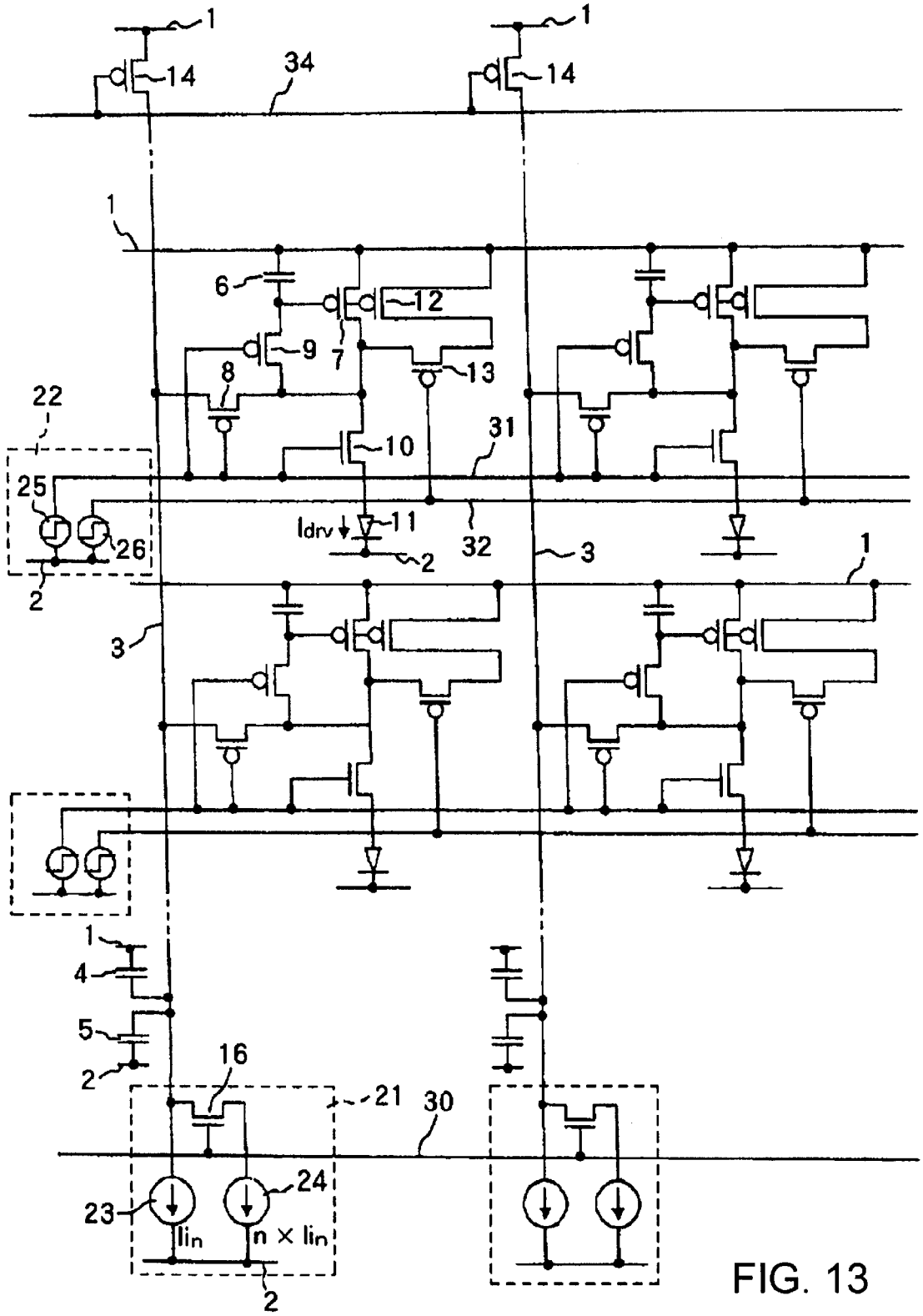
FIG. 13 is a circuit diagram of an image display apparatus which incorporates drive circuits shown in FIG. 12.

A second embodiment of the present invention will be described below. FIG. 12 shows a circuit arrangement of a drive circuit according to the second embodiment, and FIG. 13 shows an image display apparatus which comprises a matrix of current-driven devices 11 each associated with the drive circuit shown in FIG. 12. Those parts shown in FIGS. 12 and 13 which are identical to those shown in FIGS. 4 and 5 are denoted by identical reference characters.

The circuit shown in FIGS. 12 and 13 differs from the circuit shown in FIGS. 4 and 5 in that there is added switch element 14 for setting the potential of signal line 3 forcibly to the potential of power supply line 1 in the reset period. Switch element 14 is associated with each signal line 3, so that the drive circuits in the same column share one switch element 14. As shown in FIG. 13, switch element 14 comprises a p-channel MOS FET having a source connected to power supply line 1 and a drain connected to signal line 3. The gates of switch elements 14 are connected commonly to control line 34. A control circuit, not shown, outputs a control signal for rendering switch elements 14 conductive during the reset period to control line 34.

Figure 14:
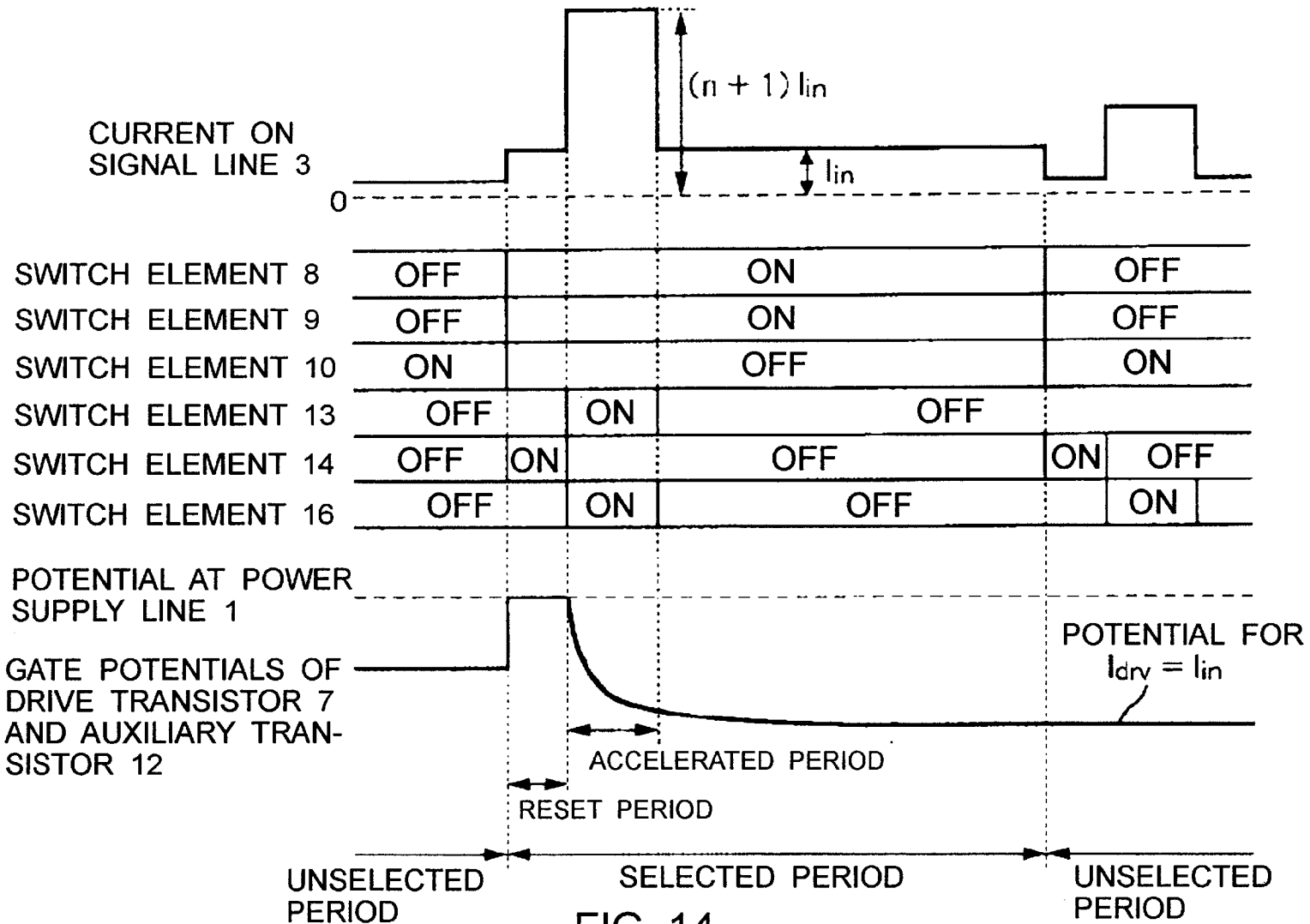
FIG. 14 is a timing chart showing operation of the circuit shown in FIGS. 12 and 13.

FIG. 14 is a timing chart of operation of the circuit shown in FIGS. 12 and 13. As can be seen from the timing chart, during the reset period, switch element 14 is rendered conductive (i.e., ON state) to set the potential of signal line 3 to the potential of power supply line 1, and also to set the gate potential of drive transistor 7 and auxiliary transistor 12 to the potential of power supply line 1. After the reset period is finished, a current $(n+1)\times I_{in}$ flows through signal line 3 to ground line 2, charging parasitic capacitor 4 and holding capacitor 6 and discharging parasitic capacitor 5. Therefore, the gate potential of drive transistor 7 and auxiliary transistor 12 drop from the potential of power supply line 1 substantially to a potential corresponding to signal current $I_{in}$. Other details of operation of the circuit shown in FIGS. 12 and 13 are the same as those shown in the timing chart of FIG. 6.

Drive circuits handled by the present invention are arranged such that a signal current flows from the drive circuit to ground line 2. Therefore, if the gate potential of drive transistor 7 is lower than the potential corresponding to the signal current $I_{in}$ during the selected period, then it is expected that it takes a considerable time until the gate potential rises to the potential corresponding to the signal current $I_{in}$. According to the present embodiment, the gate potential of drive transistor 7 is pulled up to the potential of power supply line 1 which is the highest potential in the circuit during the reset period, so that the gate potential can quickly reach the potential corresponding to the signal current $I_{in}$.

Figure 15:
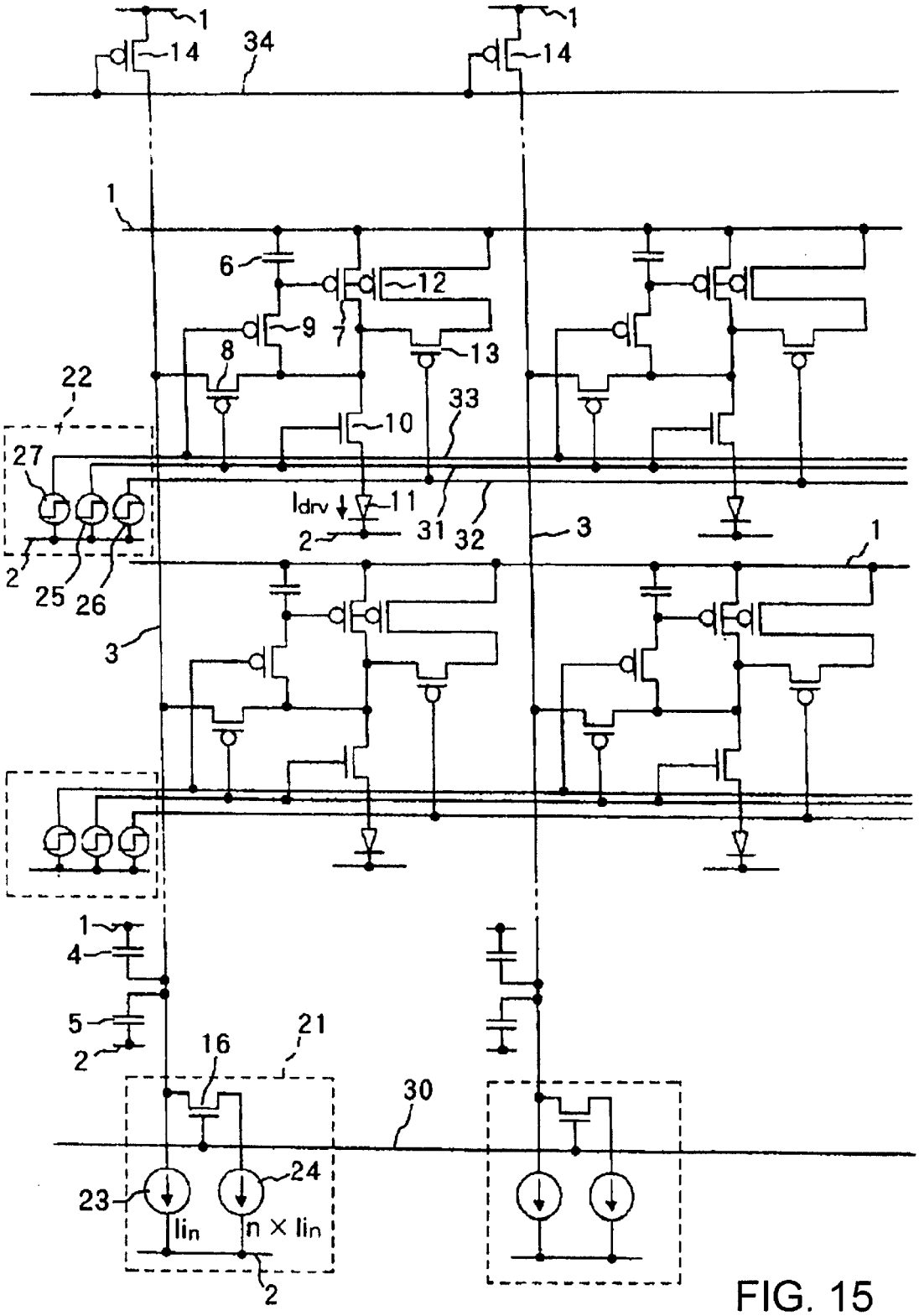
FIG. 15 is a circuit diagram of a modification of the circuit shown in FIGS. 12 and 13.
Figure 16:
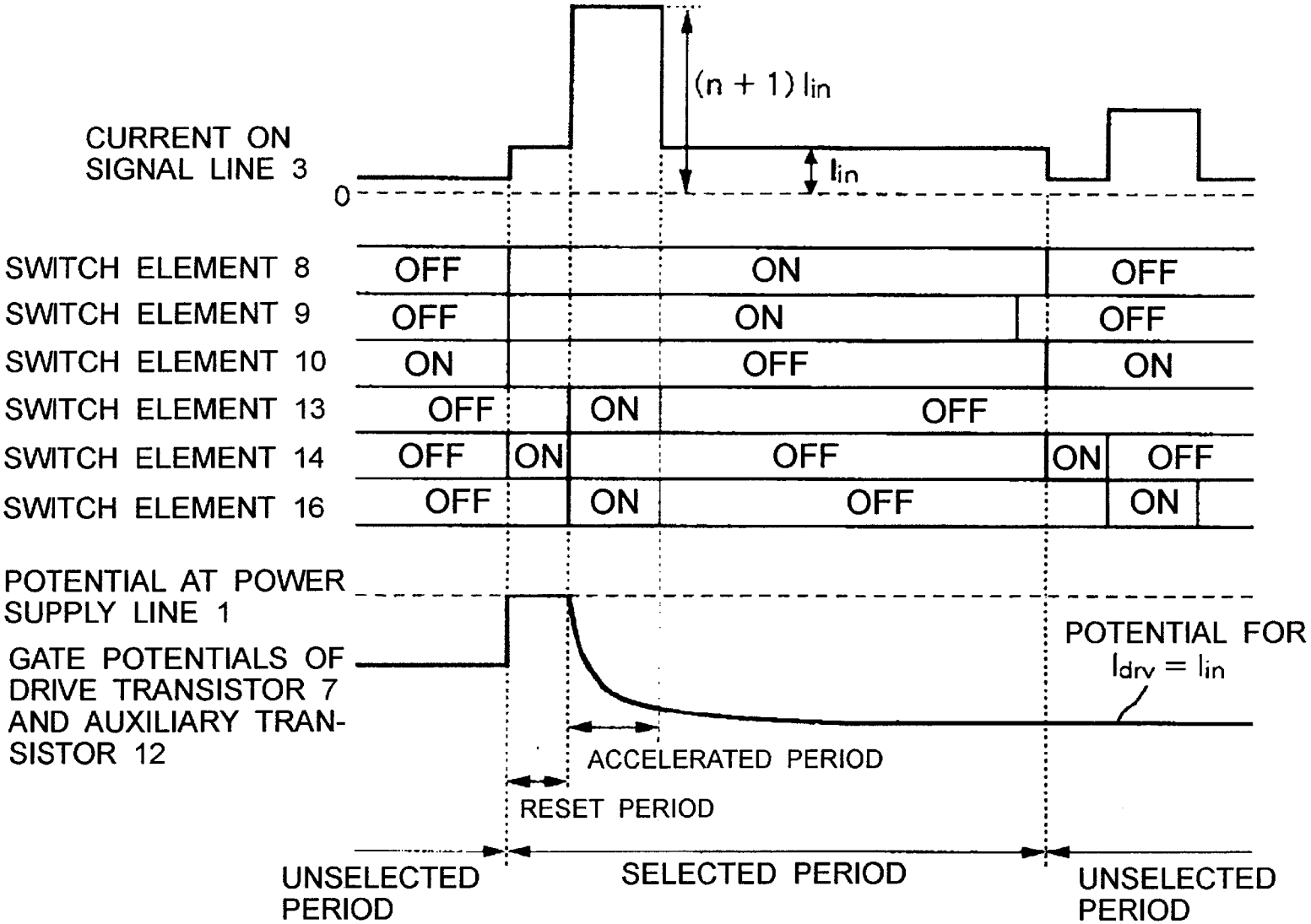
FIG. 16 is a timing chart showing operation of the circuit shown in FIG. 15.

In the above circuit according to the second embodiment, as described with reference to FIGS. 9 and 10 for the first embodiment, switch element 9 may be rendered nonconductive slightly before the selected period changes to the unselected period, thus reliably holding the gate potential with holding capacitor 6. FIG. 15 is a circuit diagram of an image display apparatus having such drive circuits, and FIG. 16 is a timing chart of operation of the circuit shown in FIG. 15.

Figure 17:
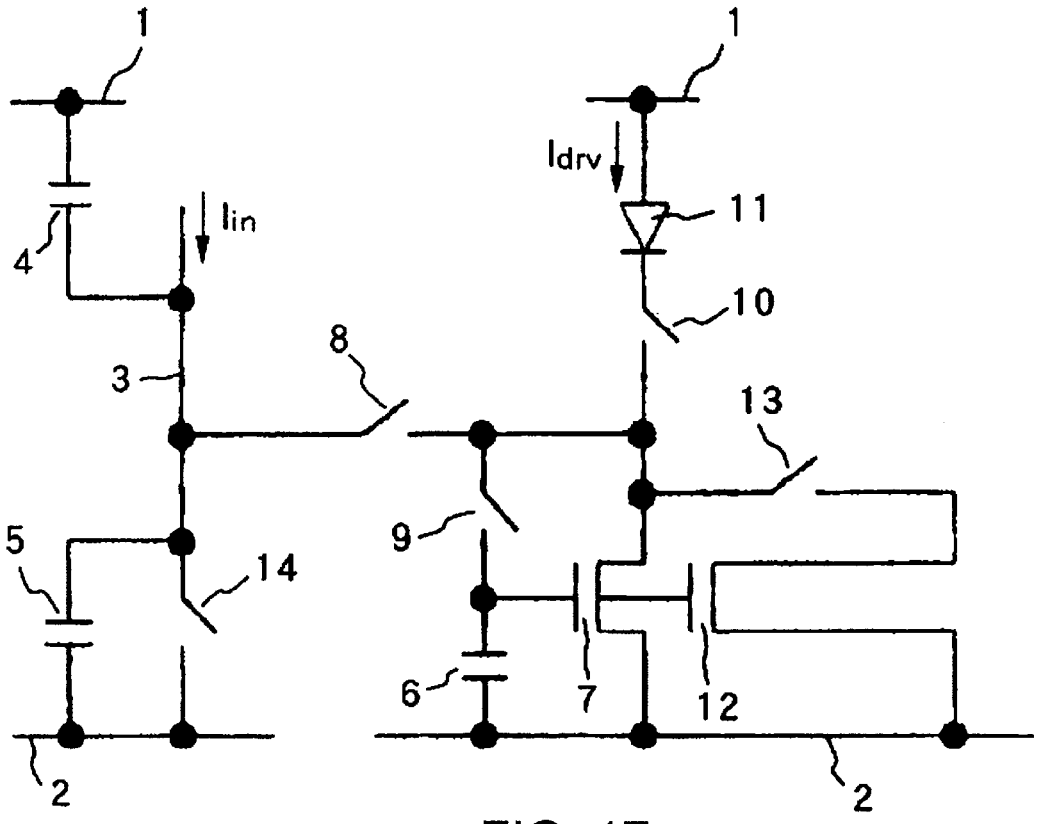
FIG. 17 is a circuit diagram of another modification of the circuit shown in FIG. 12.

FIG. 17 shows another modification of the drive circuit according to the second embodiment. In the above circuit, if current-driven device 11 comprises an organic EL element, then the organic EL element is used in a common cathode configuration, and p-channel MOS FETS are used as drive transistor 7 and auxiliary transistor 12. In the circuit shown in FIG. 17, as with the circuit shown in FIG. 11, an organic EL element is used in a common anode configuration, i.e., the anode of an organic EL element used as current-driven device 11 is connected directly to power supply line 1, and drive transistor 7 and auxiliary transistor 12, each comprising an n-channel MOS FET, are associated with the cathode of the organic EL element. If MOS FETS are used as switch elements 8 through 10, 13 and so on, then the conductivity type thereof should preferably be a reversal of the conductivity type in the circuit shown in FIGS. 12 and 13. Switch element 14 connects signal line 3 to ground line 2 in the reset period, setting the gate potential of drive transistor 7 and auxiliary transistor 12 to the ground potential. Operation of the circuit shown in FIG. 17 is similar to operation of the circuit shown in FIG. 12 except that the polarity is reversed.

Figure 18:
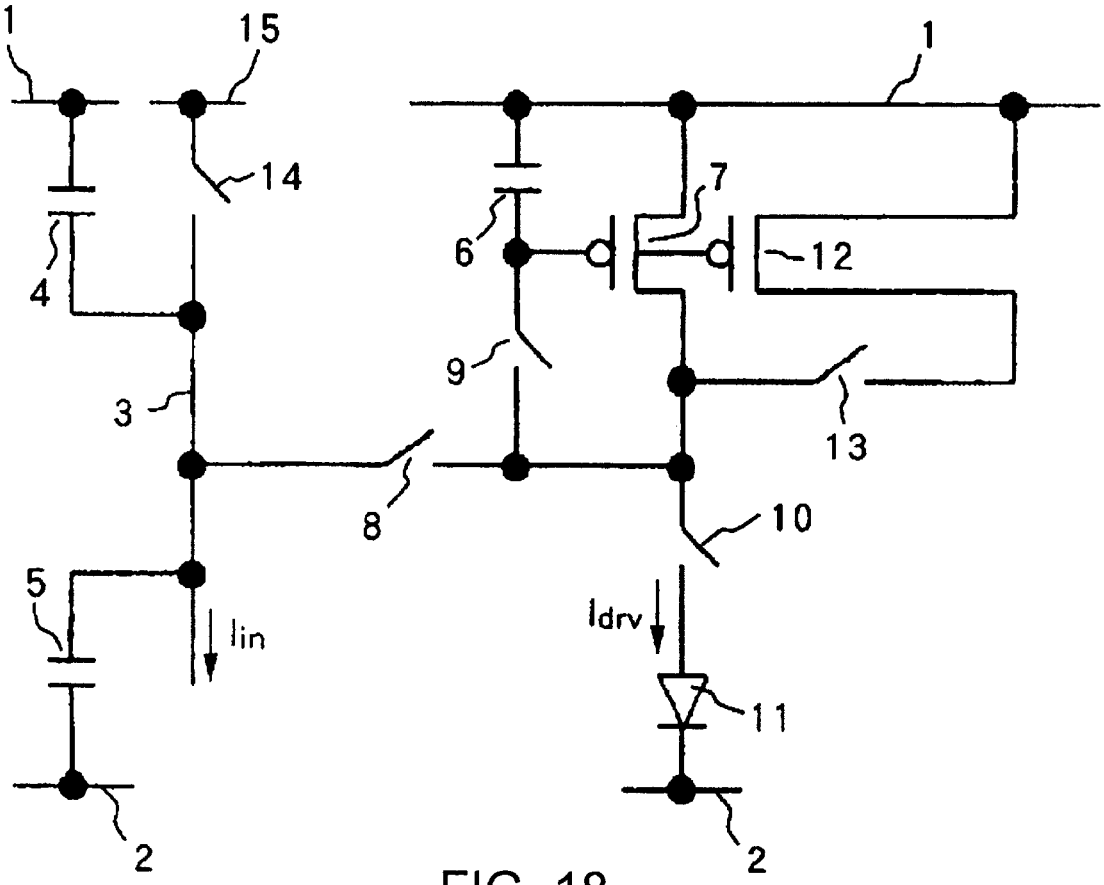
FIG. 18 is a circuit diagram of a drive circuit according to a third embodiment of the present invention.
Figure 19:
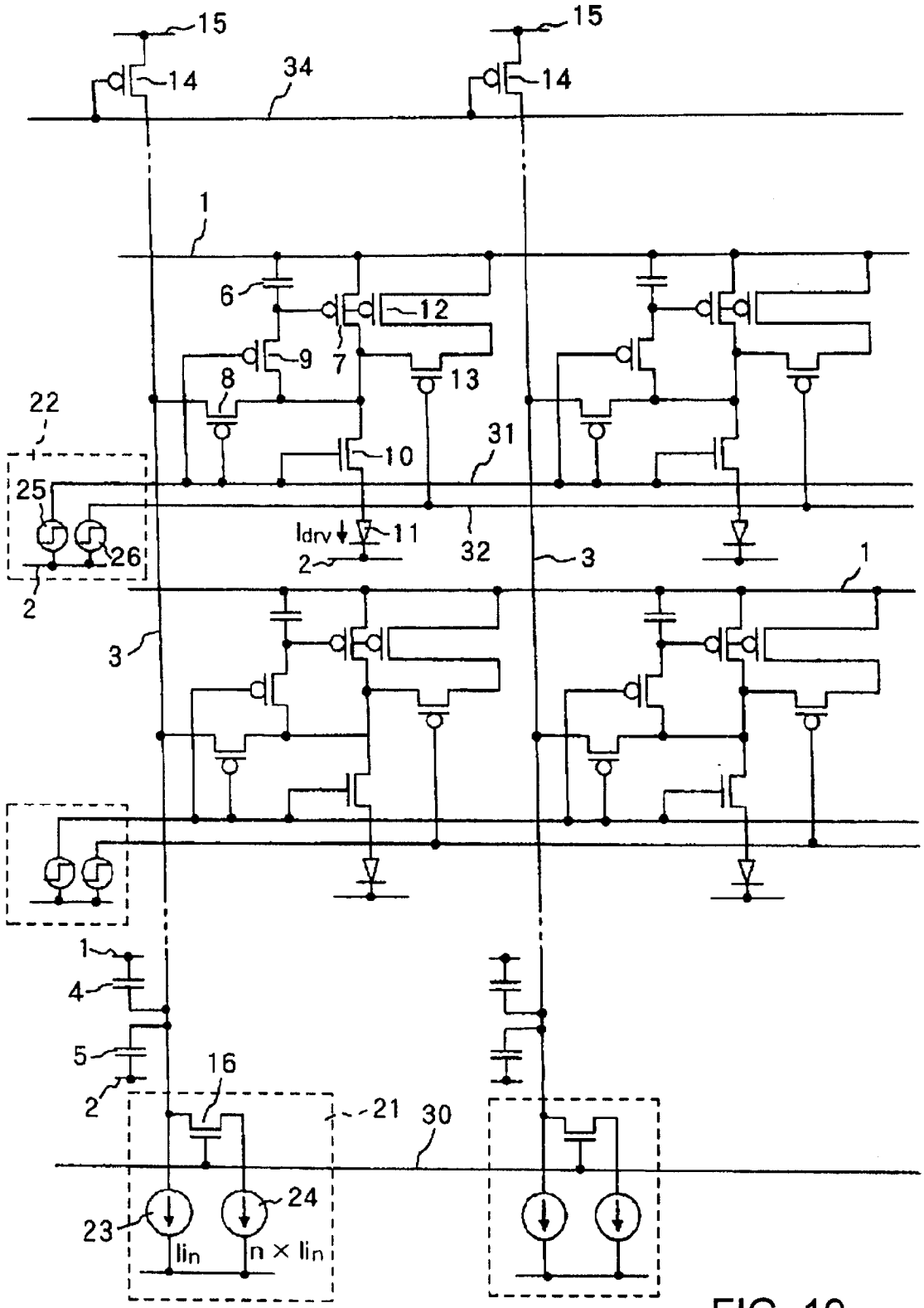
FIG. 19 is a circuit diagram of an image display apparatus which incorporates drive circuits shown in FIG. 18.

A third embodiment of the present invention will be described below. FIG. 18 shows a circuit arrangement of a drive circuit according to the third embodiment, and FIG. 19 shows an image display apparatus which comprises a matrix of current-driven devices 11 each associated with the drive circuit shown in FIG. 18. Those parts shown in FIGS. 18 and 19 which are identical to those shown in FIGS. 12 and 13 are denoted by identical reference characters.

The circuit according to the third embodiment differs from the circuit according to the second embodiment in that it has voltage line 15 having a potential lower than the potential of power supply line 1, and switch element 14 connects voltage line 15 and signal line 3 to each other in the reset period, equalizing the gate potential of drive transistor 7 and auxiliary transistor 12 to the potential of voltage line 15.

The potential of voltage line 15 is selected to be equal to or greater than $V_{cc}-V_{thmin}$ in view of characteristic variations of drive transistor 7 and auxiliary transistor 12, $V_{thmin}$ representing a minimum threshold voltage of these transistors and $V_{cc}$ the potential of power supply line 1. Specifically, the potential of voltage line 15 is selected to be equal to or greater than the gate potential corresponding to a conceivable minimum value of the signal current $I_{in}$.

In the circuit according to the second embodiment, the gate potential of drive transistor 7 and auxiliary transistor 12 is set to the potential $V_{cc}$ of power supply line 1 by switch element 14 during the reset period. In the circuit according to the third embodiment, the gate potential of drive transistor 7 and auxiliary transistor 12 is set to the potential of voltage line 15 which is lower than the potential of power supply line 1. As a result, according to the third embodiment, an amount of charges for charging parasitic capacitor 4 and holding capacitor 6 and discharging parasitic capacitor 5 may be reduced by an amount corresponding to the difference between the potential of power supply line 1 and the potential of voltage line 15. As a consequence, it is possible to make shorter the time required for the gate potential of drive transistor 7 and auxiliary transistor 12 to reach a potential at which the drain current of drive transistor 7 becomes the signal current $I_{in}$, than with the circuit according to the second embodiment. This means that the reset period and the selected period can be shortened, and the frame rate of the image display apparatus based on the matrix operation can be increased.

Figure 20:
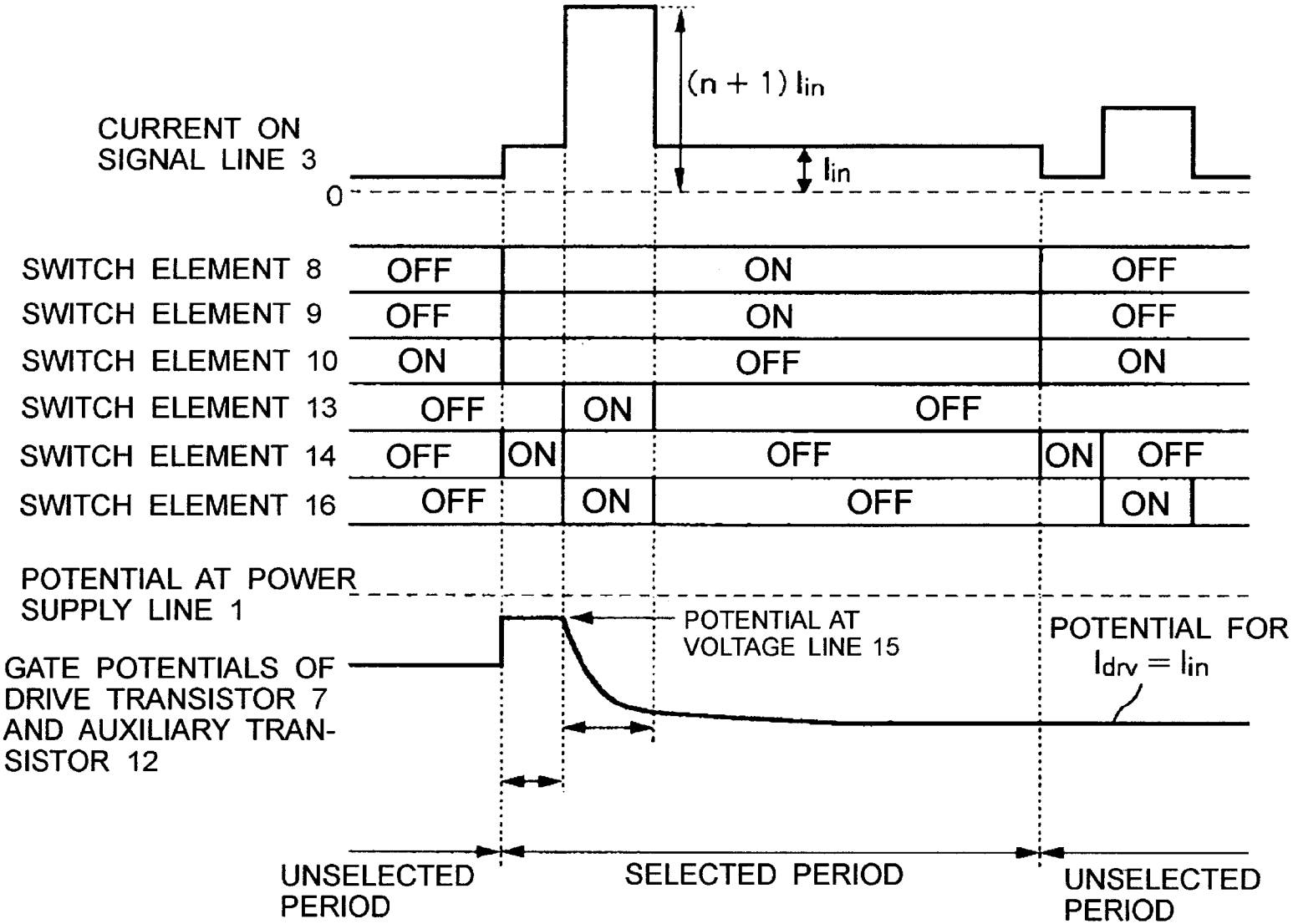
FIG. 20 is a timing chart showing operation of the circuit shown in FIGS. 18 and 19.

FIG. 20 is a timing chart of operation of the circuit according to the third embodiment.

Figure 21:
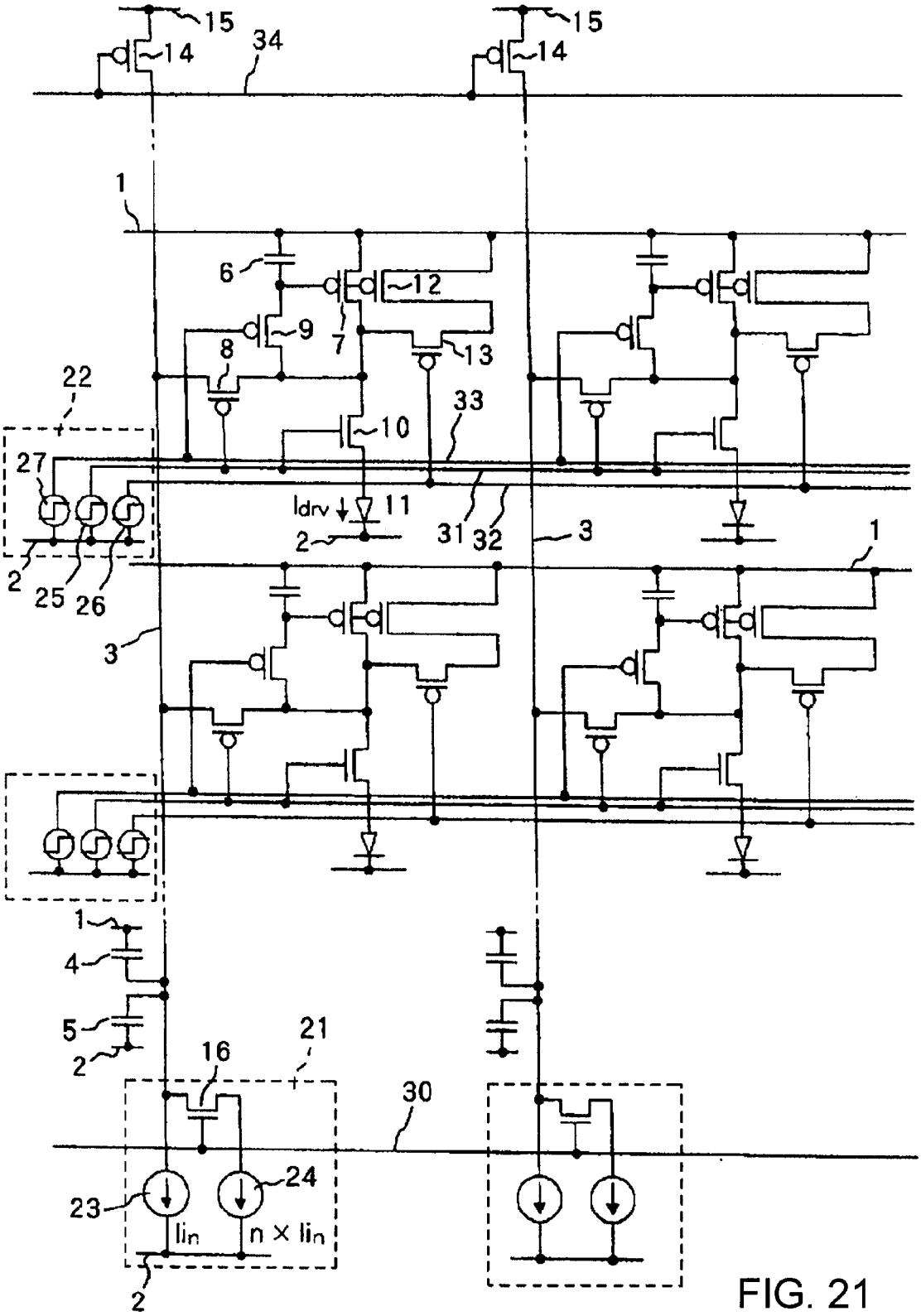
FIG. 21 is a circuit diagram of a modification of the circuit shown in FIGS. 18 and 19.
Figure 22:
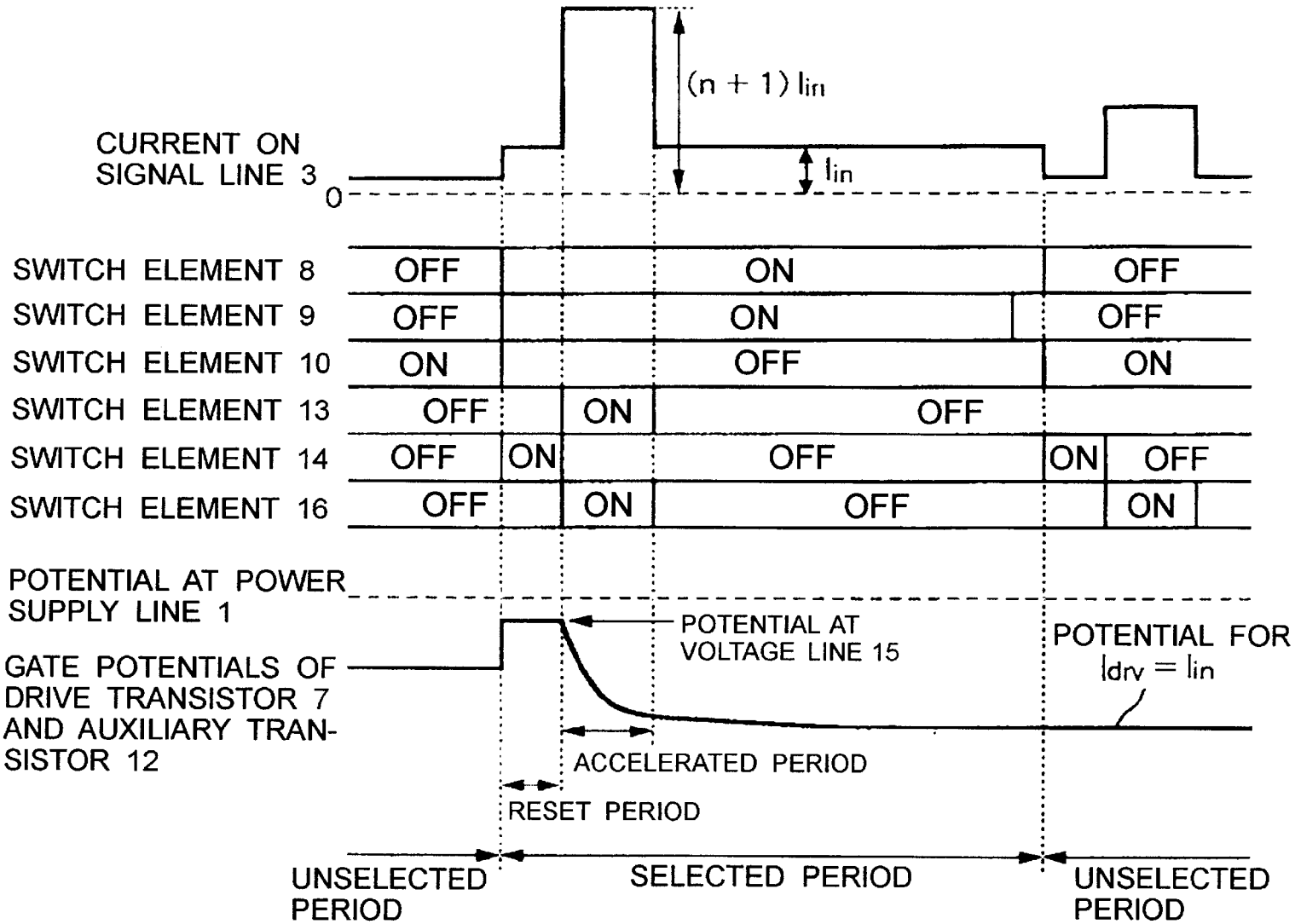
FIG. 22 is a timing chart showing operation of the circuit shown in FIG. 21.

In the above circuit according to the third embodiment, as described with reference to FIGS. 9 and 10 for the first embodiment, switch element 9 may be rendered nonconductive slightly before the selected period changes to the unselected period, thus reliably holding the gate potential with holding capacitor 6. FIG. 21 is a circuit diagram of an image display apparatus having such drive circuits, and FIG. 22 is a timing chart of operation of the circuit shown in FIG. 21.

Figure 23:
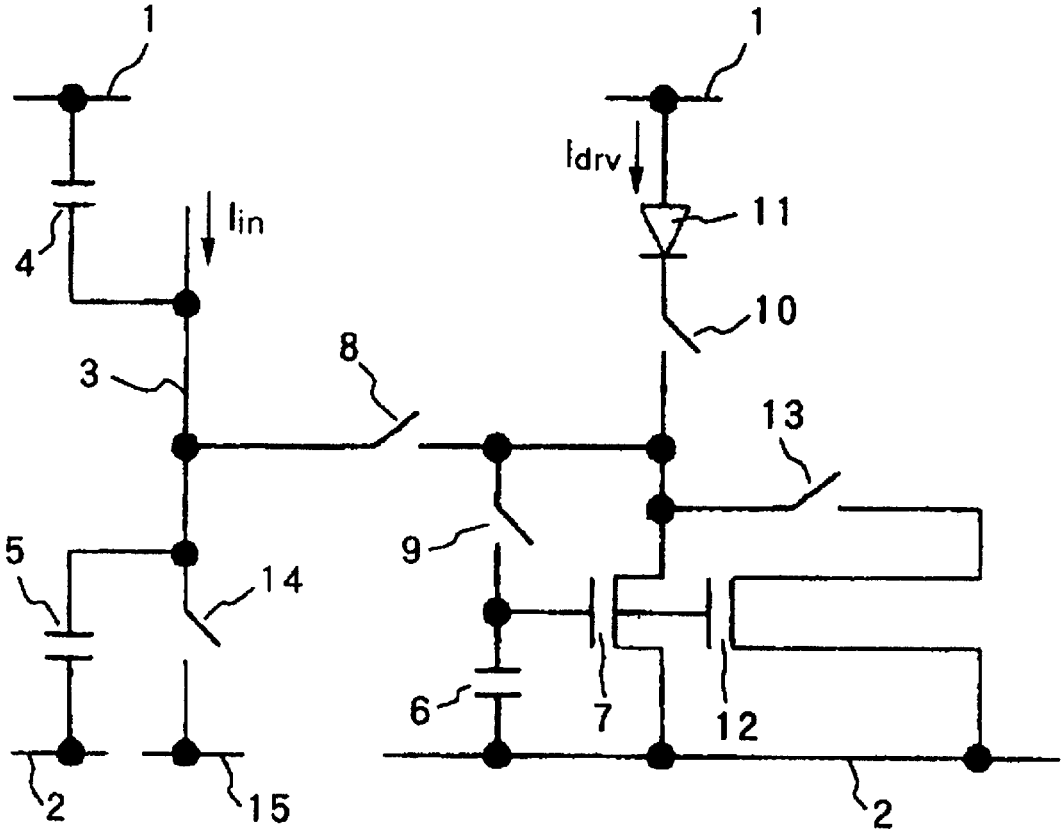
FIG. 23 is a circuit diagram of another modification of the circuit shown in FIG. 18.

FIG. 23 shows another modification of the drive circuit according to the third embodiment. In the above circuit, if current-driven device 11 comprises an organic EL element, then the organic EL element is used in a common cathode configuration, and p-channel MOS FETs are used as drive transistor 7 and auxiliary transistor 12. In the circuit shown in FIG. 23, as with the circuit shown in FIG. 11, an organic EL element is used in a common anode configuration, i.e., the anode of an organic EL element used as current-driven device 11 is connected directly to power supply line 1, and drive transistor 7 and auxiliary transistor 12, each comprising an n-channel MOS FET, are associated with the cathode of the organic EL element. If MOS FETs are used as switch elements 8 through 10, 13 and so on, then the conductivity type thereof should preferably be a reversal of the conductivity type in the circuit shown in FIGS. 18 and 19. A potential slightly higher than the potential of ground line 2 is applied to voltage line 15. Specifically, the potential of voltage line 15 is selected to be equal to or smaller than $V_{thmin}$ in view of characteristic variations of drive transistor 7 and auxiliary transistor 12, $V_{thmin}$ representing a minimum threshold voltage of these transistors. Switch element 14 connects signal line 3 to voltage line 15 in the reset period, setting the gate potential of drive transistor 7 and auxiliary transistor 12 to a voltage slightly higher than the ground potential. Operation of the circuit shown in FIG. 23 is similar to operation of the circuit shown in FIG. 18 except that the polarity is reversed.

While drive transistor 7 and auxiliary transistor 12 have been described as MOS FETs preferably provided as thin-film transistors in the above preferred embodiments, the present invention is not limited to those transistors. Instead, drive transistor 7 and auxiliary transistor 12 may comprise insulated-gate transistors of the same conductivity type. In an application to image display apparatus, drive transistor 7 and auxiliary transistor 12 should preferably comprise thin-film transistors. While each switch element has been described as a MOS FET, the present invention is not limited to such a MOS FET, but may employ any of switch elements of other types such as a transfer gate.

While preferred embodiments of the present invention have been described in specific terms, such description is for illustrative purposes only, and it is to be understood that changes and variations may be made without departing from the spirit or scope of the following claims.

What is claimed is:

1. A drive circuit for driving a current-driven device, comprising:

a signal line for passing therethrough a signal current corresponding to a drive current of the current-driven device;

a drive transistor having a gate, a drain, and a source connected to a power supply line;

a holding capacitor connected between said power supply line and the gate of said drive transistor;

a first switch element for connecting said signal line and the drain of said drive transistor to each other;

a second switch element for connecting the gate and drain of said drive transistor to each other;

a third switch element for connecting the drain of said drive transistor and an end of said current-driven device to each other;

an auxiliary transistor having a gate connected to the gate of said drive transistor, a source connected to the source of said drive transistor, and a drain connected to the drain of said drive transistor; and a fourth switch element for turning on and off a source-to-drain current of said auxiliary transistor.

2. The drive circuit according to claim 1, wherein said fourth switch element is inserted between the drain of said drive transistor and the drain of said auxiliary transistor.

3. The drive circuit according to claim 1, further comprising:

a fifth switch element connecting said power supply line and said signal line to each other.

4. The drive circuit according to claim 1, further comprising:

a voltage line to which a predetermined voltage is applicable; and a fifth switch element connecting said voltage line and said signal line to each other;

said predetermined voltage as seen from a ground potential having an absolute value smaller than the absolute value of the voltage of said power supply line.

5. The drive circuit according to claim 1, wherein said auxiliary transistor has a current driving capability which is n times the current driving capability of said drive transistor, further comprising:

a first current source connected to said signal line for generating the signal current;

a second current source for generating a current which is n times the signal current generated by said first current source; and a signal line switch element connecting said second current source to said signal line.

6. The drive circuit according to claim 1, wherein said drive transistor and said auxiliary transistor comprise thin-film transistors of identical conductivity type having respective insulated gates.

7. The drive circuit according to claim 1, wherein each of said first, second, third and fourth switch element comprises a MOS field-effect transistor.

8. A drive circuit according to claim 1, wherein said current-driven device comprises an organic EL element.

9. A method of driving a current-driven device, comprising the steps of:

providing a drive circuit according to claim 1;

alternately establishing a selected period in which said current-driven device is selected and a signal current for the current-driven device is passed through said signal line, and an unselected period in which said current-driven device is not selected;

keeping said first, second, and fourth switch element nonconductive and keeping said third switch element conductive in said unselected period;

rendering said first and second switch elements conductive and rendering said third switch element nonconductive when said unselected period changes to said selected period;

establishing an accelerated period in said selected period, and rendering said fourth switch element conductive and making the magnitude of the signal current flowing through said signal line (n+1) times a normal value in said accelerated period where n represents the ratio of a current driving capability of said auxiliary transistor to a current driving capability of said drive transistor; and holding said fourth switch element nonconductive and returning the magnitude of said signal current to the normal value after said accelerated period is finished until said selected period is finished.

10. The method according to claim 9, wherein said second switch element is rendered nonconductive after said accelerated period is finished and before said selected period is finished.

11. The method according to claim 9, wherein said current-driven device comprises an organic EL element.

12. A method of driving a current-driven device, comprising the steps of:

providing a drive circuit according to claim 3;

alternately establishing a selected period in which said current-driven device is selected and a signal current for the current-driven device is passed through said signal line, and an unselected period in which said current-driven device is not selected;

keeping said first, second, and fourth switch element nonconductive and keeping said third switch element conductive in said unselected period;

rendering said first and second switch elements conductive and rendering said third switch element nonconductive when said unselected period changes to said selected period;

rendering said fifth switch element conductive during a reset period which is a predetermined period from the time when said unselected period changes to said selected period;

establishing an accelerated period following elapse of said reset period in said selected period, and rendering said fourth switch element conductive and making the magnitude of the signal current flowing through said signal line (n+1) times a normal value in said accelerated period where n represents the ratio of a current driving capability of said auxiliary transistor to a current driving capability of said drive transistor;

holding said fourth switch element nonconductive and returning the magnitude of said signal current to the normal value after said accelerated period is finished until said selected period is finished; and keeping said fifth switch element nonconductive during a period other than said reset period in said selected period.

13. The method according to claim 12, wherein said second switch element is rendered nonconductive after said accelerated period is finished and before said selected period is finished.

14. The method according to claim 12, wherein said current-driven device comprises an organic EL element.

15. An image display apparatus comprising:

a matrix of light-emitting devices for emitting light when driven by a current, said light-emitting devices being associated with respective pixels;

a plurality of signal lines provided in respective columns of said pixels for supplying signal currents corresponding to drive currents for the light-emitting devices associated with selected ones of said pixels; and a plurality of control lines provided in respective rows of said pixels for transmitting control signals;

each of said pixels comprising:

a drive transistor having a gate, a drain, and a source connected to a power supply line;

a holding capacitor connected between said power supply line and the gate of said drive transistor;

a first switch element for connecting said signal line and the drain of said drive transistor to each other depending on said control signal;

a second switch element for connecting the gate and drain of said drive transistor to each other depending on said control signal;

a third switch element connecting the drain of said drive transistor and an end of said light-emitting device to each other depending on said control signal;

an auxiliary transistor having a gate connected to the gate of said drive transistor, a source connected to the source of said drive transistor, and a drain connected to the drain of said drive transistor; and a fourth switch element for turning on and off a source-to-drain current of said auxiliary transistor depending on said control signal.

16. The image display apparatus according to claim 15, which is driven by:

alternately establishing a selected period in which a row of pixels is selected and a signal current for light-emitting devices belonging to the selected row is passed through said signal line, and an unselected period in which said row is not selected;

keeping said first, second, and fourth switch element nonconductive and keeping said third switch element conductive in said unselected period;

rendering said first and second switch elements conductive and rendering said third switch element nonconductive when said unselected period changes to said selected period;

establishing an accelerated period in said selected period, and rendering said fourth switch element conductive and making the magnitude of the signal current flowing through said signal line (n+1) times a normal value in said accelerated period where n represents the ratio of a current driving capability of said auxiliary transistor to a current driving capability of said drive transistor; and holding said fourth switch element nonconductive and returning the magnitude of said signal current to the normal value after said accelerated period is finished until said selected period is finished.

17. The image display apparatus according to claim 16, wherein said second switch element is rendered nonconductive after said accelerated period is finished and before said selected period is finished.

18. The image display apparatus according to claim 15, wherein said current-driven device comprises an organic EL element.

19. An image display apparatus comprising:

a matrix of light-emitting devices for emitting light when driven by a current, said light-emitting devices being associated with respective pixels;

a plurality of signal line provided in respective columns of said pixels for supplying signal currents corresponding to drive currents for the light-emitting devices associated with selected ones of said pixels; and a plurality of control lines provided in respective rows of said pixels for transmitting control signals;

each of said pixels comprising:

a drive transistor having a gate, a drain, and a source connected to a power supply line;

a holding capacitor connected between said power supply line and the gate of said drive transistor;

a first switch element for connecting said signal line and the drain of said drive transistor to each other depending on said control signal;

a second switch element for connecting the gate and drain of said drive transistor to each other depending on said control signal;

a third switch element connecting the drain of said drive transistor and an end of said light-emitting device to each other depending on said control signal;

an auxiliary transistor having a gate connected to the gate of said drive transistor, a source connected to the source of said drive transistor, and a drain connected to the drain of said drive transistor; and a fourth switch element for turning on and off a source-to-drain current of said auxiliary transistor depending on said control signal;

said image display apparatus further comprising:

a fifth switch element associated with each of said signal lines, for connecting the signal line to a predetermined potential.

20. The image display apparatus according to claim 19, which is driven by:

alternately establishing a selected period in which a row of pixels is selected and a signal current for light-emitting devices belonging to the selected row is passed through said signal line, and an unselected period in which said row is not selected;

keeping said first, second, and fourth switch element nonconductive and keeping said third switch element conductive in said unselected period;

rendering said first and second switch elements conductive and rendering said third switch element nonconductive when said unselected period changes to said selected period;

rendering said fifth switch element conductive during a reset period which comprises a predetermined period from the time when said unselected period changes to said selected period;

rendering said fourth switch element conductive and making the magnitude of the signal current flowing through said signal line (n+1) times a normal value in an accelerated period which is established following elapse of said reset period in said selected period where n represents the ratio of a current driving capability of said auxiliary transistor to a current driving capability of said drive transistor;

holding said fourth switch element nonconductive and returning the magnitude of said signal current to the normal value after said accelerated period is finished until said selected period is finished; and keeping said fifth switch element nonconductive during a period other than said reset period in said selected period.

21. The image display apparatus according to claim 20, wherein said second switch element is rendered nonconductive after said accelerated period is finished and before said selected period is finished.

* * * * *

UNITED STATES PATENT AND TRADEMARK OFFICE

CERTIFICATE OF CORRECTION

PATENT NO. : 6,839,057 B2
DATED : January 4, 2005
INVENTOR(S) : Koichi Iguchi

It is certified that error appears in the above-identified patent and that said Letters Patent is hereby corrected as shown below:

Column 20,
Line 35, add the following claim 22 as follows:
-- 22. The image display apparatus according to claim 19, wherein said current-driven device comprises an organic EL element. --

Signed and Sealed this

Fifteenth Day of March, 2005

JON W. DUDAS
*Director of the United States Patent and Trademark Office*